US007223121B2

(12) United States Patent
Moriyama et al.

(10) Patent No.: US 7,223,121 B2
(45) Date of Patent: May 29, 2007

(54) CABLE CONNECTOR FOR BALANCED TRANSMISSION

(75) Inventors: Satoshi Moriyama, Shinagawa (JP); Takahiro Kondou, Shinagawa (JP); Kiyoshi Sato, Shinagawa (JP); Mitsuru Kobayashi, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/378,375

(22) Filed: Mar. 20, 2006

(65) Prior Publication Data

US 2006/0270271 A1 Nov. 30, 2006

(30) Foreign Application Priority Data

May 31, 2005 (JP) ..... 2005-160285
Dec. 27, 2005 (JP) ..... 2005-375813

(51) Int. Cl.
*H01R 12/24* (2006.01)

(52) U.S. Cl. ..... 439/497; 439/607; 439/660

(58) Field of Classification Search ..... 439/101, 439/497, 499, 607, 610, 660
See application file for complete search history.

(56) References Cited

U.S. PATENT DOCUMENTS 5,267,875 A * 12/1993 Koegel et al. ..... 439/497
6,482,028 B2 * 11/2002 Kumamoto et al. ..... 439/498
6,905,366 B2 * 6/2005 Yang ..... 439/607
7,040,918 B2 * 5/2006 Moriyama et al. ..... 439/497
2003/0060086 A1 * 3/2003 Ozai ..... 439/660

FOREIGN PATENT DOCUMENTS

JP 2003-59593 2/2003

* cited by examiner

*Primary Examiner*—Khiem Nguyen
(74) *Attorney, Agent, or Firm*—Staas & Halsey LLP

(57) ABSTRACT

A cable connector for balanced transmission is disclosed. A spacer member is attached to a contact assembly body in the cable connector for balanced transmission, a first signal wire connecting part of a first signal contact member is inserted into a first groove of the spacer member, a second signal wire connecting part of a second signal contact member is inserted into a second groove of the spacer member, and a ground contact member is inserted in a slit of the spacer member, so that their positions are decided. A cable for balanced transmission includes plural pairs of wires, and a first signal wire of the pair of wires is soldered to the first signal connecting part, a second signal wire thereof is soldered to the second signal connecting part, and a drain wire thereof is soldered to a drain wire connecting part of the ground contact member.

12 Claims, 32 Drawing Sheets

$L_1 > L_2$
$L_{1a} > L_{2a}$
$L_{1b} > L_{2b}$

CABLE CONNECTOR FOR BALANCED TRANSMISSION

BACKGROUND OF THE INVENTION

1. Field of the Invention

The present invention generally relates to a cable connector for balanced transmission in which a number of pairs of wires are used.

2. Description of the Related Art

As data transmission systems, there are systems such as a normal transmission system that uses a wire for each data signal, and a balanced transmission system that uses a pair of wires for each data signal and transmits a + signal and a − signal, whose size is the same as that of the + signal with the opposite direction from the + signal, at the same time. The balanced transmission system has an advantage of being relatively immune to noise compared with the normal transmission system. Therefore, the balanced transmission system has been widely used. In order to establish a transmission line that executes balanced transmission of data between apparatuses, a cable connector for balanced transmission is used. The cable connector for balanced transmission is shielded at the end of the cable for balanced transmission.

FIG. 1 is an exploded perspective view of a conventional cable connector for balanced transmission 10. FIG. 2 is a cross-sectional view of the conventional cable connector for balanced transmission 10 shown in FIG. 1. In drawings, a line X1–X2 shows the width direction, a line Y1–Y2 shows the length direction, and a line Z1–Z2 shows the height direction.

FIG. 3 is a cross-sectional view of a cable for balanced transmission 20 shown in FIG. 1. As shown in FIG. 3, the cable for balanced transmission 20 has a structure in which a number of pairs of wires 21 are disposed in a tube of a double-cover tube composed of an outer cover 27 and a shielding mesh wire 28, where each of the wires 21 has a pair of first and second covered signal wires 22-1 and 22-2 for balanced signal transmission and a drain wire 25 banded by a spirally-wrapped metal tape. As shown in FIG. 6, from the end of the pair of wires 21, the first and second covered signal wires 22-1 and 22-2 and the drain wire 25 are extended, and the covers at the tips of the first and second covered signal wires 22-1 and 22-2 are removed and first and second signal wires 23-1 and 23-2, respectively, (tips of the first and second covered signal wires 22-1 and 22-2) are naked and exposed. The first signal wire 23-1 pairs up with the second signal wire 23-2.

As shown in FIGS. 1 and 2, in the cable connector for balanced transmission 10, a relay board 12 is provided at the Y1 side of a contact assembly body 11, and the first and second signal wires 23-1 and 23-2 and the drain wire 25 further extending from the pairs of wires 21 extended from the end of the cable for balanced transmission 20 are soldered to terminals of the Y1 side of-the relay board 12. In addition, shielding covers 31 and 32 cover the contact assembly body 11, the relay board 12, and the end part of the cable for balanced transmission 20. In the cable connector for balanced transmission 10, the contact assembly body 11, the relay board 12, and the ends of the cable for balanced transmission 20 form data transmission paths (refer to Patent Document 1).

[Patent Document 1] Japanese Laid-Open Patent Application No. 2003-059593

In the cable connector for balanced transmission 10, when the shield between the adjacent two data transmission paths is studied, there is a problem in the part of the relay board 12. That is, the relay board 12 has a structure in which wiring patterns extending in the Y1–Y2 direction are formed on the upper face and the lower face of the relay board 12 in a manner so that the wiring patterns are arrayed in the X1–X2 direction, and the wiring pattern on the upper face pairs up with the wiring pattern on the lower face at the same position. Consequently, it is difficult to provide excellent shielding at the place between adjacent wiring patterns in the X1–X2 direction comparable to the shielding degree at the contact assembly body 11.

Recently, the signal speeds in clients and servers have become high; therefore, a bad influence on transmission characteristics caused by poor shielding at the relay board 12 cannot be ignored.

In addition, a cable connector for balanced transmission is required for which low cost manufacturing and highly efficient assembly can be achieved.

SUMMARY OF THE INVENTION

Accordingly, the present invention may provide a cable connector for balanced transmission in which transmission characteristics of high speed signals are improved.

According to a preferred embodiment of the present invention, there is provided a cable connector for balanced transmission. The cable connector for balanced transmission includes a contact assembly body having a block body made of an electrically insulating material in which a pair including first and second signal contact members and a ground contact member are alternately arrayed. A first signal wire connecting part being a part of the first signal contact member sticks out from the back face of the block body, a second signal wire connecting part being a part of the second signal contact member sticks out from the back face of the block body, and a plate part and a drain wire connecting part at the end of the plate part being parts of the ground contact member stick out from the back face of the block body. The cable connector for balanced transmission further includes a cable for balanced transmission having plural pairs of wires in which the first and second signal wires and the drain wire are disposed. A tip of the first signal wire is connected to the first signal wire connecting part, a tip of the second signal wire is connected to the second signal wire connecting part, and a tip of the drain wire is connected to the drain wire connecting part. The cable connector for balanced transmission further includes a spacer member being a plate-shaped member made of an electrically insulating material that has first grooves having a shape corresponding to the first signal wire connecting part, second grooves having a shape corresponding to the second signal wire connecting part, and slits having a shape corresponding to the plate part of the ground contact member. The spacer member is attached to the back face of the block body, and the first signal wire connecting part is inserted into the first groove, the second signal wire connecting part is inserted into the second groove, and the plate part is inserted into the slit; with these connections, the positions of the first and second signal contact members and the ground contact members in relation to the tips of the cable for balanced transmission are decided.

According to embodiments of the present invention, the positions of the first and second signal wire connecting parts and the drain wire connecting part can be easily decided by the spacer member.

In addition, according to the embodiments of the present invention, the first and second signal wires of the cable for balanced transmission are respectively connected to the first and second signal wire connecting parts whose positions are decided, and the drain wire of the cable for balanced transmission is connected to the drain wire connecting part whose position is decided. Therefore, connecting wires can be executed in a stable manner without deforming the first and second signal wire connecting parts and the drain wire connecting part. Consequently, the manufacturing efficiency becomes high.

In addition, the first and second signal wires are directly connected to the first and second signal contact members, respectively, without being connected via a relay board. Therefore, the crosstalk characteristic of the cable connector for balanced transmission of an embodiment of the present invention is improved.

In addition, the ground contact members sandwich the first and second signal contact members therebetween and shield them. Consequently, the shielding effect for the first and second signal wires is improved.

Other objects and further features of the present invention will be apparent from the following detailed description when read in conjunction with the accompanying drawings.

DESCRIPTION OF THE PREFERRED EMBODIMENTS

Figure 1:
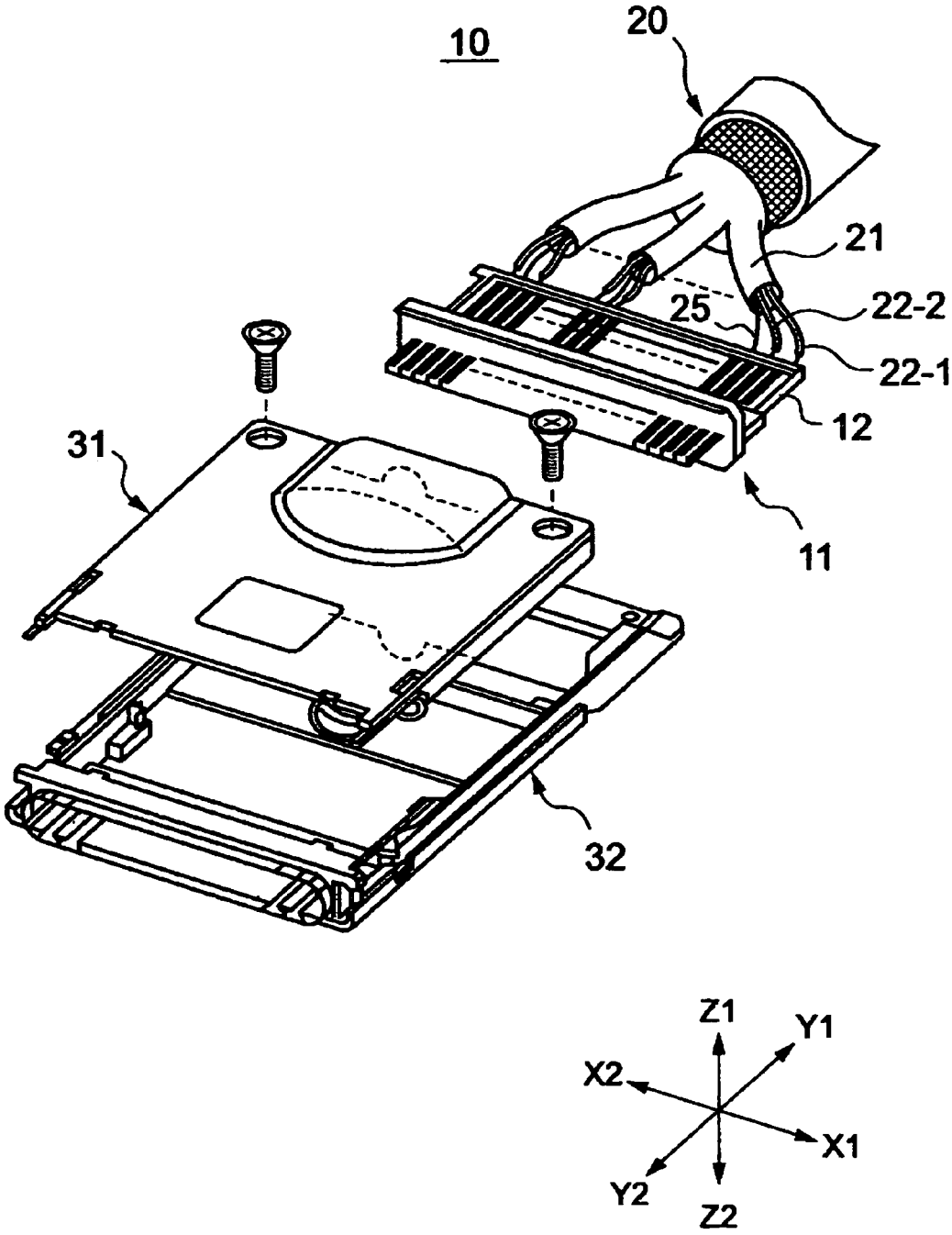
FIG. 1 is an exploded perspective view of a conventional cable connector for balanced transmission.
Figure 2:
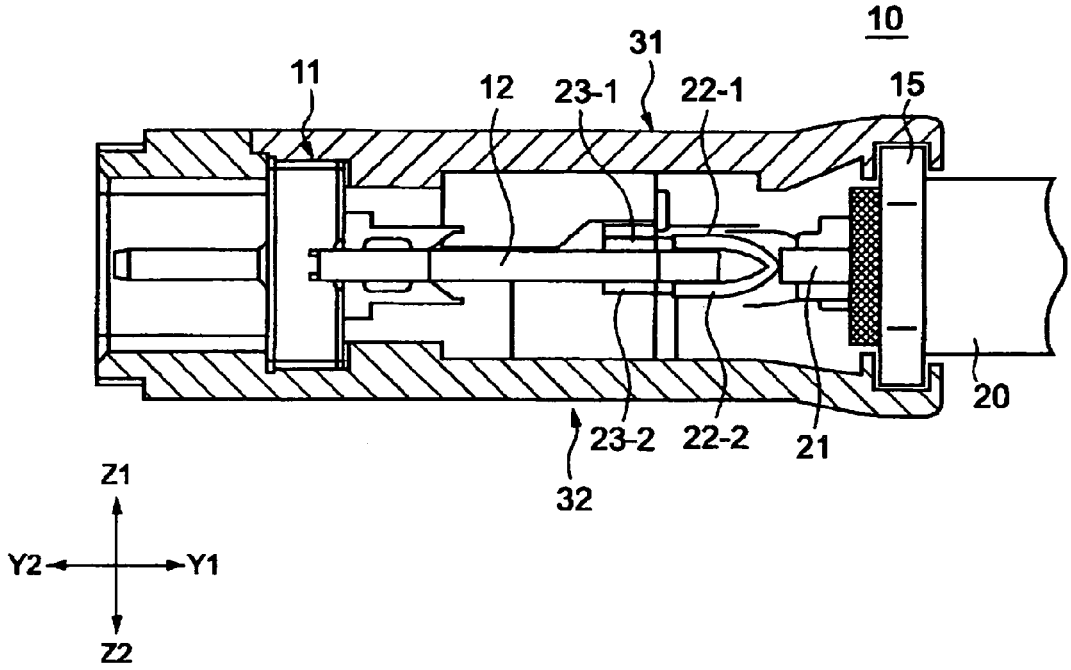
FIG. 2 is a cross-sectional view of the conventional cable connector for balanced transmission shown in FIG. 1.
Figure 3:
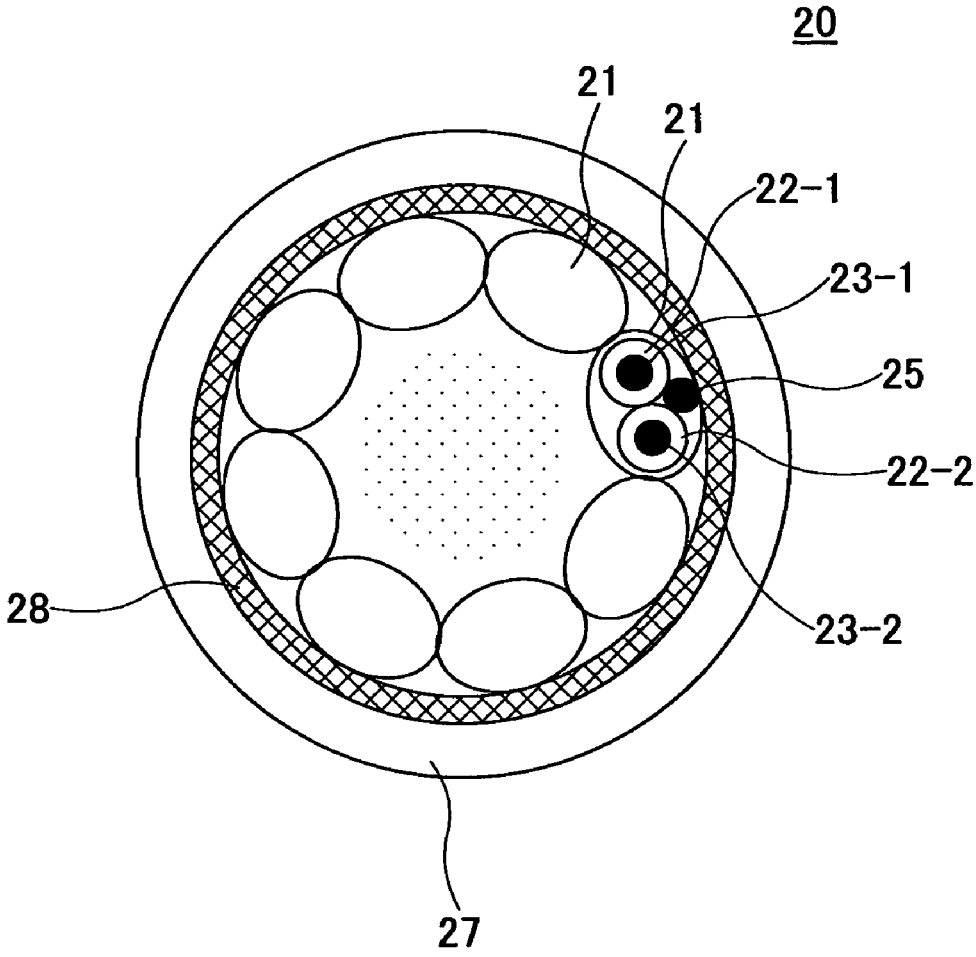
FIG. 3 is a cross-sectional view of a cable for balanced transmission shown in FIG. 1.

Referring to the drawings, embodiments of the present invention are explained.

First Embodiment

Figure 4:
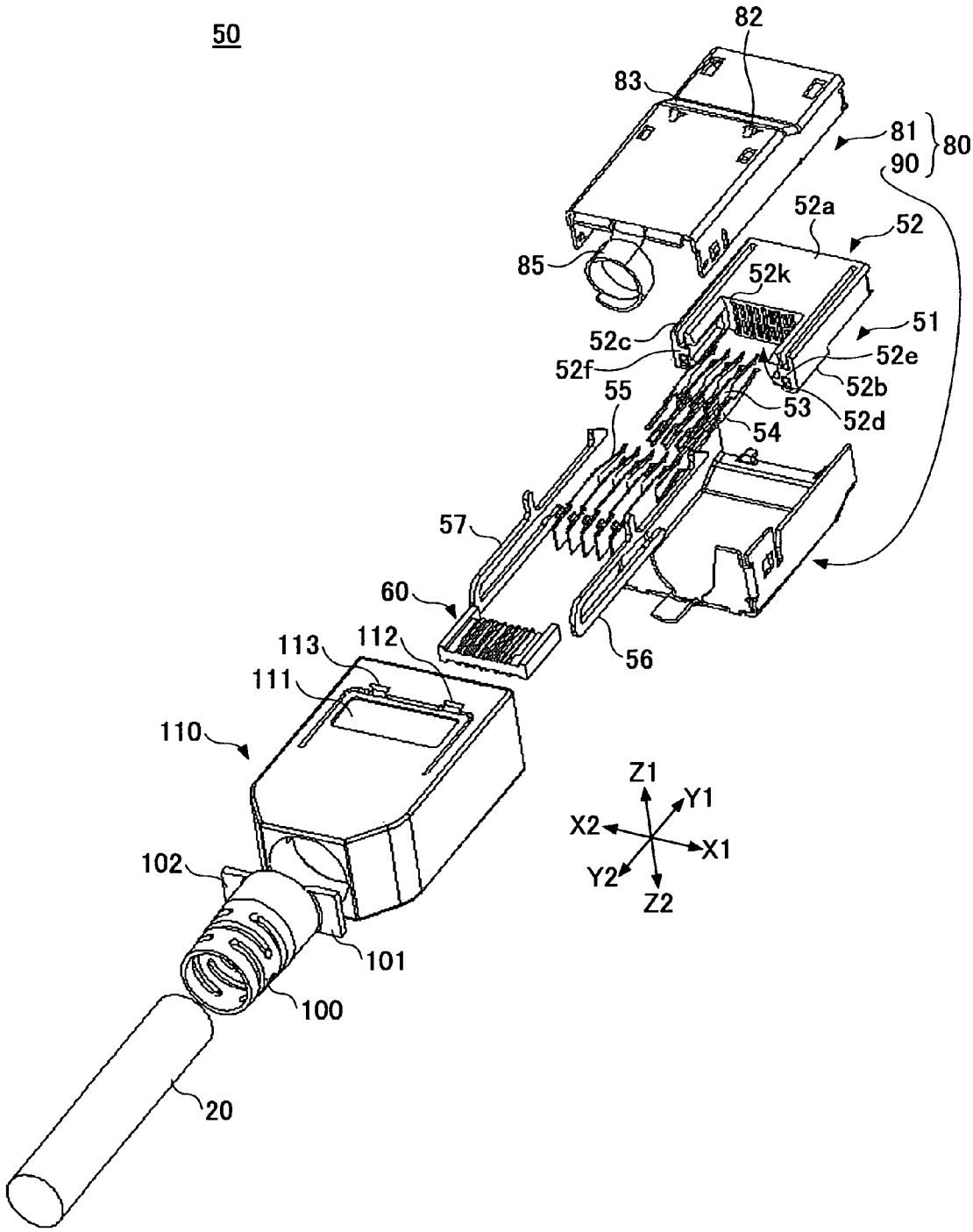
FIG. 4 is an exploded perspective view of a cable connector for balanced transmission according to a first embodiment of the present invention.
Figure 5A:
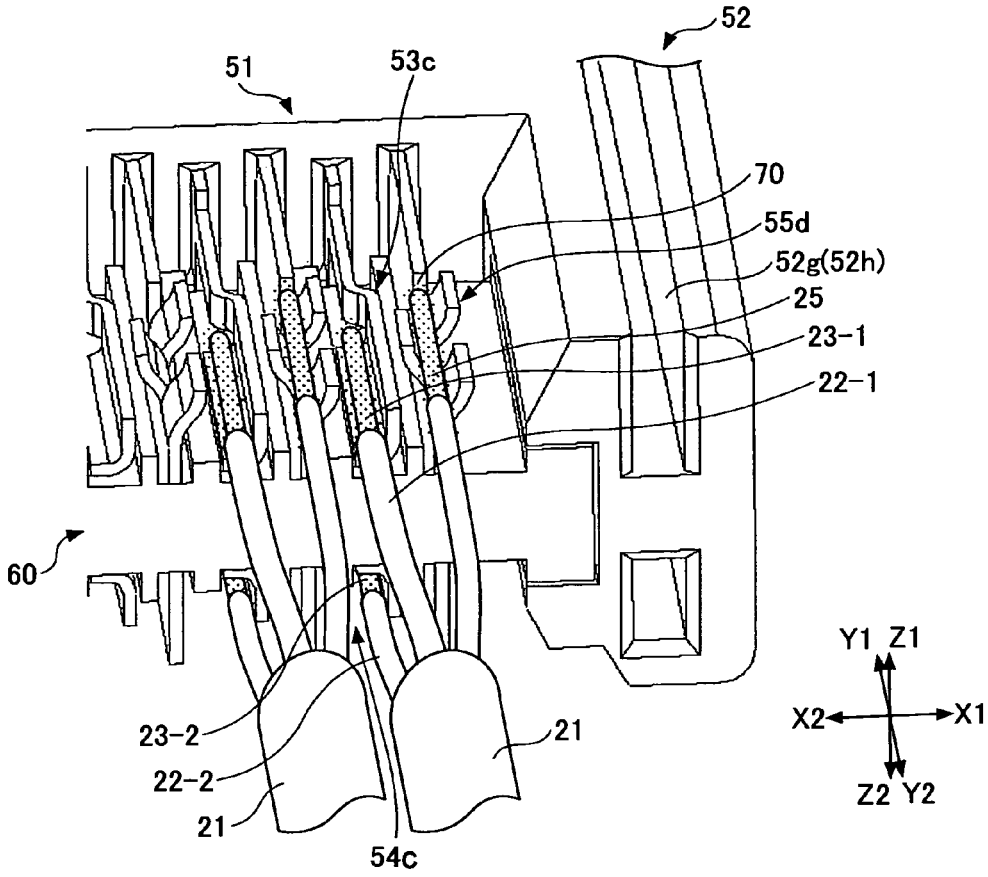
FIG. 5A is a perspective view showing tips of a cable for balanced transmission that are connected to a contact assembly body in the cable connector for balanced transmission.
Figure 5B:
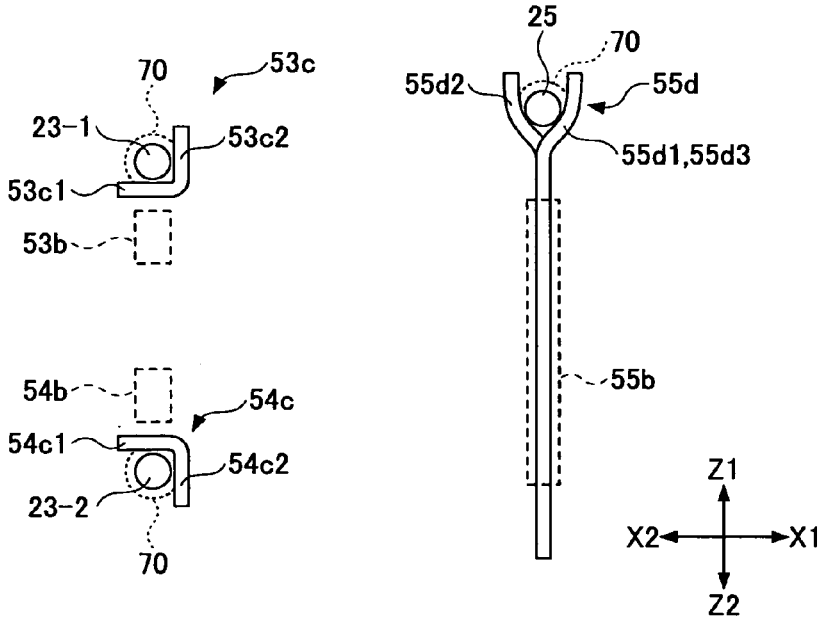
FIG. 5B is a diagram showing details of the connection shown in FIG. 5A.
Figure 6:
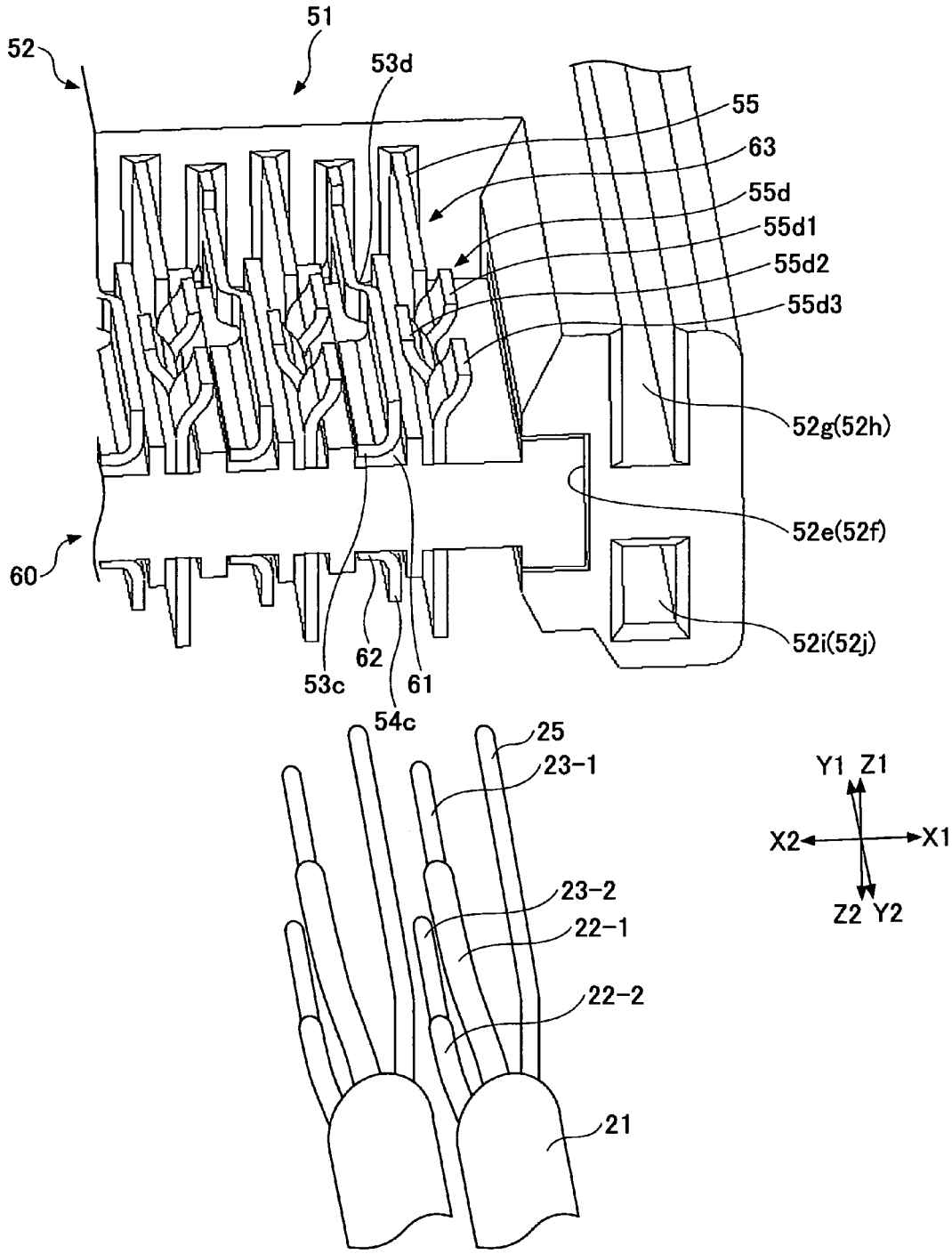
FIG. 6 is an exploded perspective view in which the tips of the cable for balanced transmission and the contact assembly body are shown.
Figure 7:
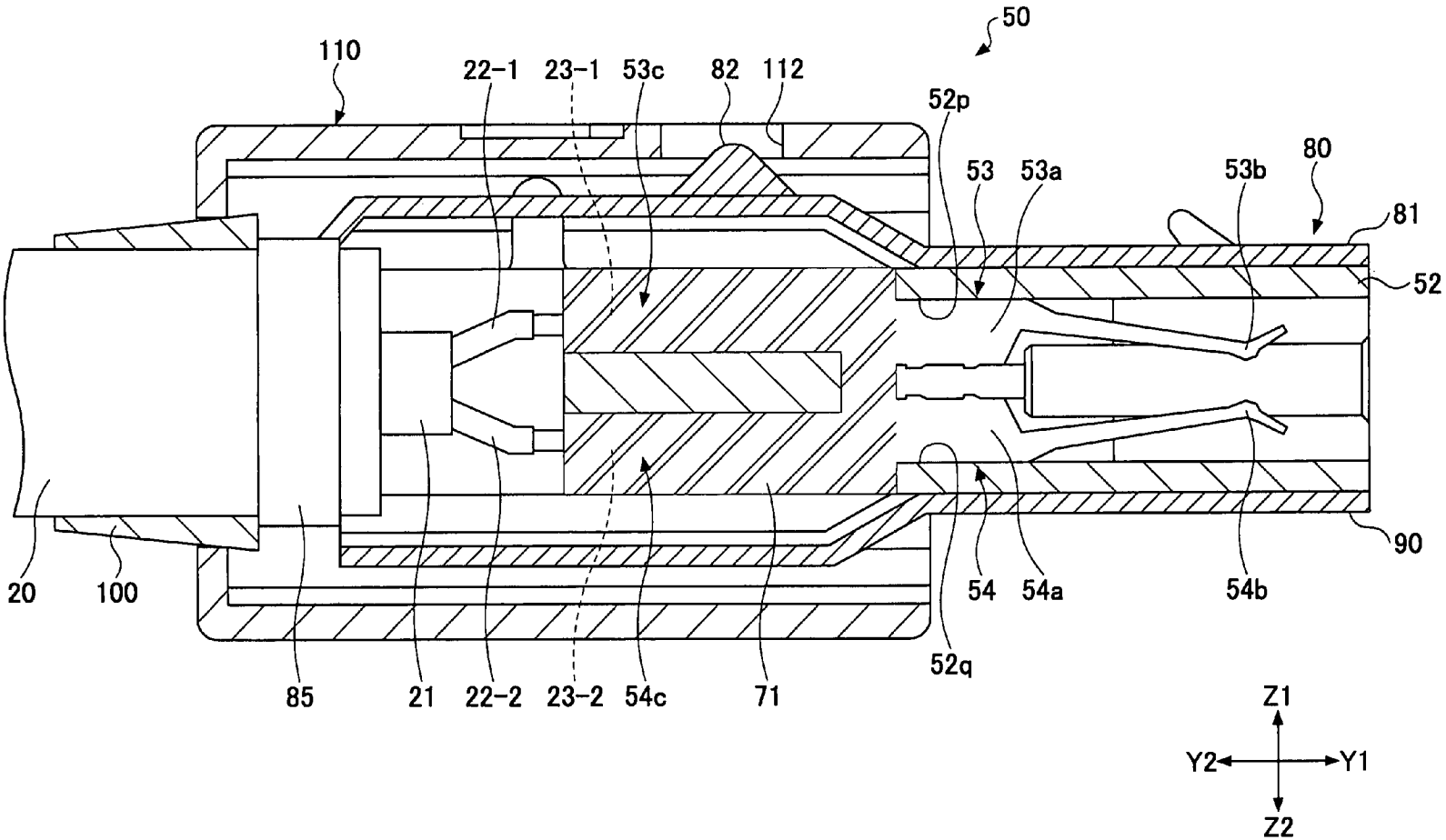
FIG. 7 is a cross-sectional view of the cable connector for balanced transmission at a position of first and second signal contact members.
Figure 8:
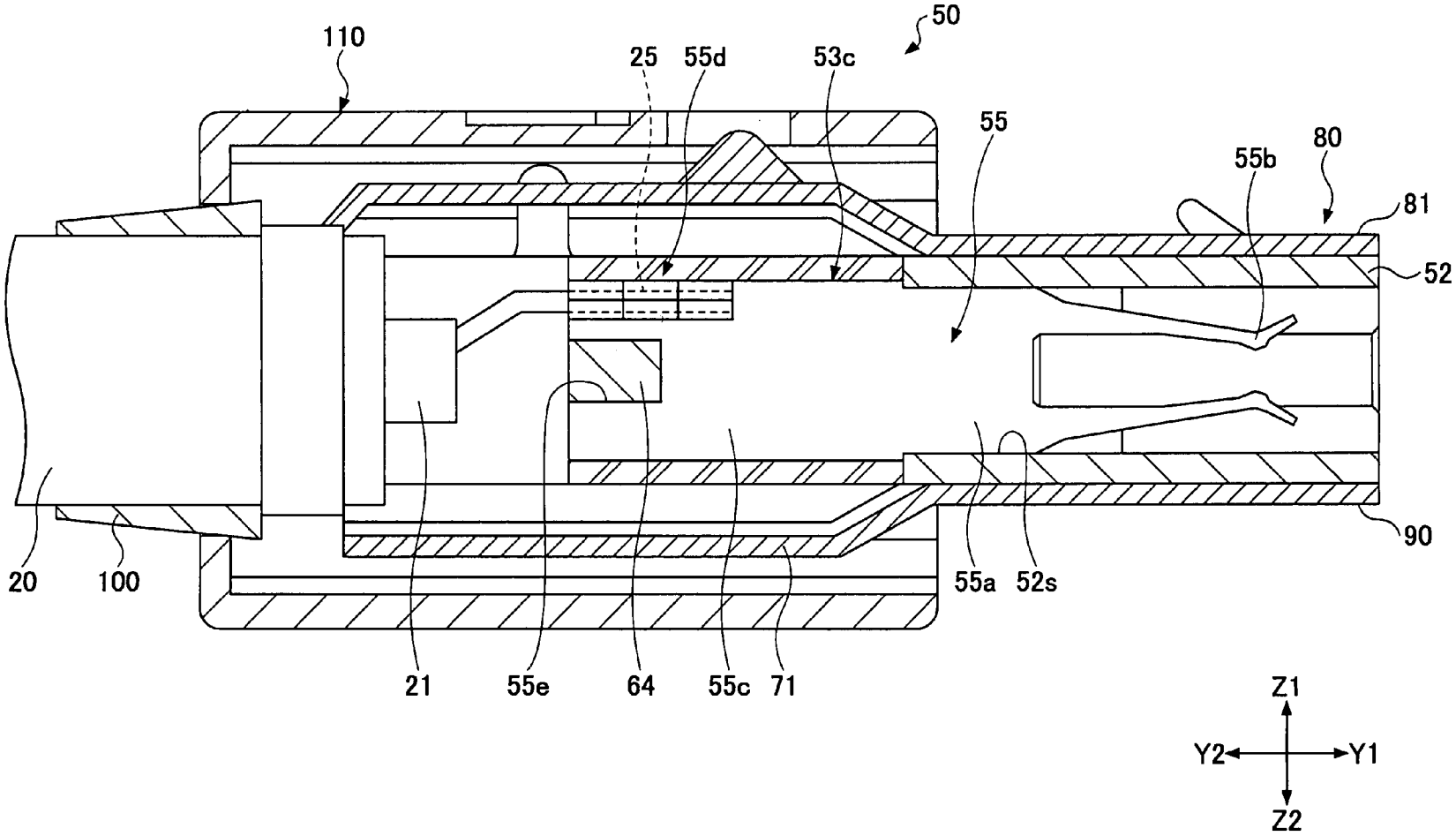
FIG. 8 is a cross-sectional view of the cable connector for balanced transmission at a position of a ground contact member.
Figure 9:
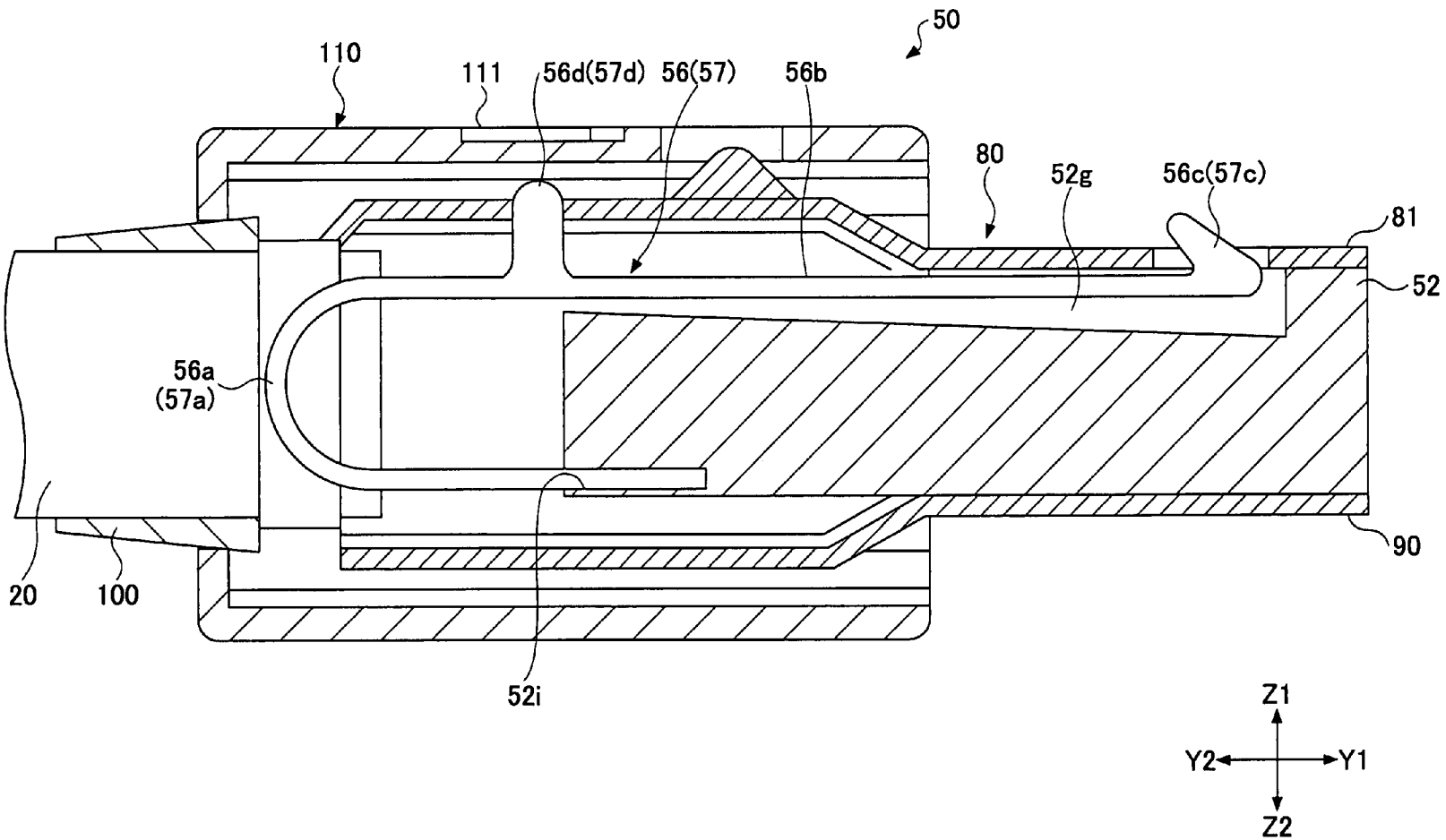
FIG. 9 is a cross-sectional view of the cable connector for balanced transmission at a position of a locking arm member.
Figure 10:
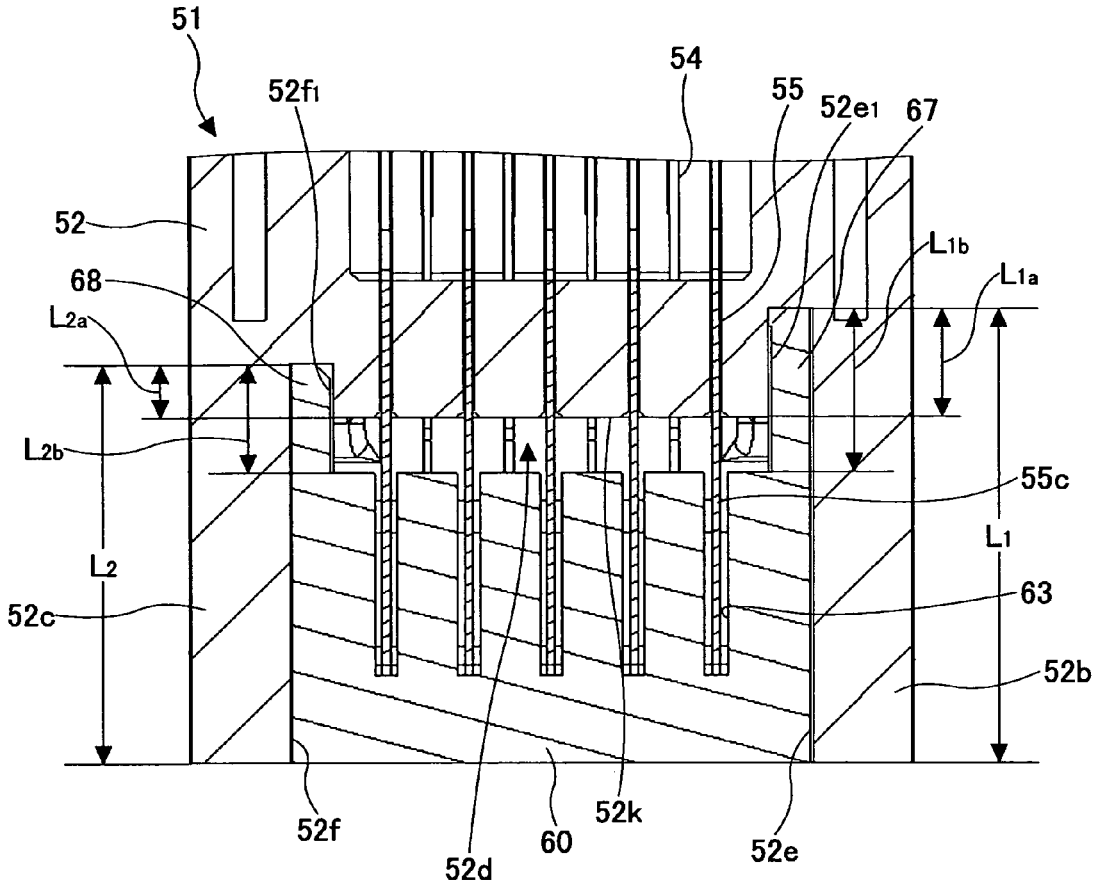
FIG. 10 is a transverse sectional-view of the cable connector for balanced transmission at a position of the contact assembly body.

FIG. 4 is an exploded perspective view of a cable connector for balanced transmission 50 according to a first embodiment of the present invention. FIG. 5A is a perspective view showing tips of a cable for balanced transmission 20 that are connected to a contact assembly body 51 in the cable connector for balanced transmission 50. FIG. 5B is a diagram showing details of the connection shown in FIG. 5A. FIG. 6 is an exploded perspective view in which the tips of the cable for balanced transmission 20 and the contact assembly body 51 are shown. FIG. 7 is a cross-sectional view of the cable connector for balanced transmission 50 at a position of first and second signal contact members 53 and 54. FIG. 8 is a cross-sectional view of the cable connector for balanced transmission 50 at a position of a ground contact member 55. FIG. 9 is a cross-sectional view of the cable connector for balanced transmission 50 at a position of a locking arm member 56. FIG. 10 is a transverse sectional-view of the cable connector for balanced transmission 50 at a position of the contact assembly body 51. In the drawings, a line X1-X2 shows the width direction, a line Y1-Y2 shows the length direction, and a line Z1-Z2 shows the height direction in the cable connector for balanced transmission 50. Further, the Y1 side is the back side of the cable connector for balanced transmission 50 and the Y2 side is the front side of the cable connector for balanced transmission 50.

As shown in FIG. 4, the cable connector for balanced transmission 50 includes the contact assembly body 51, a spacer member 60 that decides the contact position, a shielding cover assembly body 80 that surrounds the contact assembly body 51 and the spacer member 60, the cable for balanced transmission 20, a hood 100, and an outer cover 110.

[Contact Assembly body 51]

The contact assembly body 51 has a structure in which pairs of the first and second signal contact members 53 and 54 and the ground contact members 55 are alternately assembled in the X direction in a block body 52, and further, a locking arm member 56 is assembled at the X1 side of the contact assembly body 51 and a locking arm member 57 is assembled at the X2 side of the contact assembly body 51. The first signal contact member 53 is positioned at the Z1 side and the second signal contact member 54 is positioned at the Z2 side at the same position in the X direction.

As shown in FIGS. 4 through 6, the block body 52 is made of an electrically insulating resin and is an approximate flat rectangular parallelepiped. The block body 52 includes an approximately rectangular parallelepiped section 52*a* with many regularly formed holes into which the first and second signal contact members 53 and 54 and the ground contact members 55 are inserted, and arms 52*b* and 52*c* extending in the Y2 direction from corresponding sides of the X direction of the approximate rectangular parallelepiped section 52*a*. A space 52*d* is formed between the arms 52*b* and 52*c*. Guide grooves 52*e* and 52*f* are formed at facing insides of the arms 52*b* and 52*c*. The length L1 of the guide groove 52*e* and the length L2 of the guide groove 52*f* are different, and L1>L2. The length L1*a* is of a guide groove 52*e*1 is formed from the Y2 side face 52*k* inside the block body 52, and the length L2*a* of a guide groove 52*f*1 is formed from the Y2 side face 52*k* inside the block body 52, where L1*a*>L2*a* (refer to FIG. 10). In addition, in the X1 and X2 sides of the block body 52, grooves 52*g* and 52*h*, and holes 52*i* and 52*j*, respectively, are formed (refer to FIG. 6).

Figure 11:
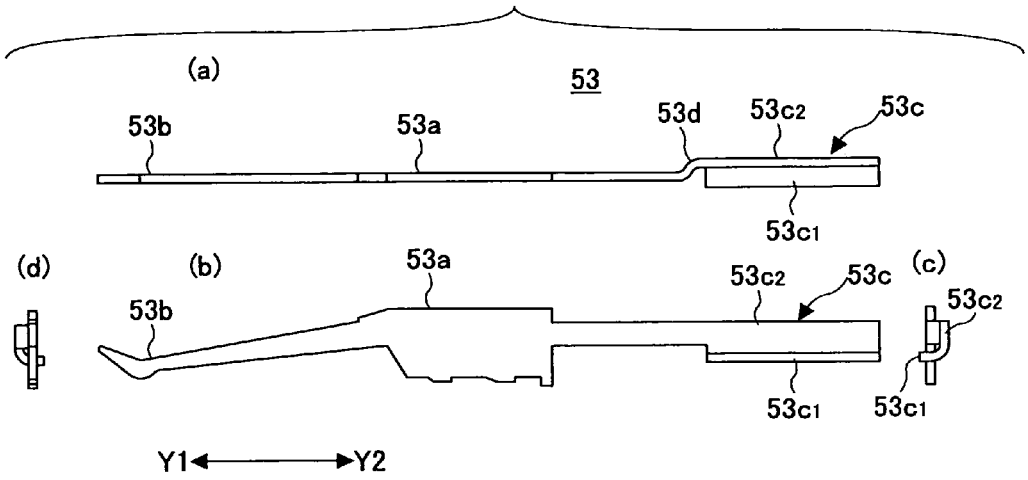
FIG. 11 is a diagram showing a first signal contact member.

FIG. 11 is a diagram showing the first signal contact member 53. In FIG. 11, (a) shows a plan view, (b) shows a side view, (c) shows a view looking from the Y2 direction, and (d) shows a view looking from the Y1 direction. As shown in FIG. 11, the first signal contact member 53 includes a center part 53*a* having a bulge part, a contact part 53*b* of the Y1 side, and a first signal wire connecting part 53*c* of the Y2 side. The first signal wire connecting part 53*c* has an L shape in its cross section, and includes a horizontal plate part 53*c*1 and a vertical side plate part 53*c*2. In addition, a bent crank part 53*d* is formed between the first signal wire connecting part 53*c* and the center part 53*a*, and the first signal wire connecting part 53*c* is slightly offset in the horizontal direction from the center part 53*a*.

Figure 12:
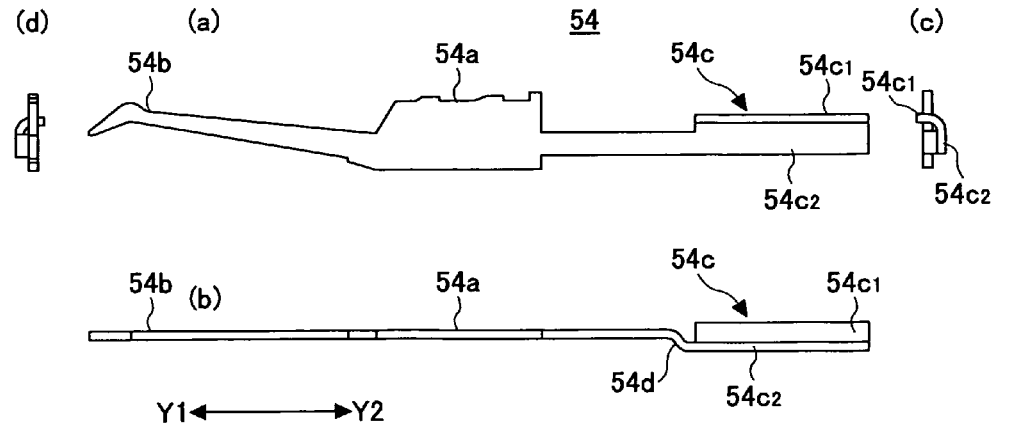
FIG. 12 is a diagram showing a second signal contact member.

FIG. 12 is a diagram showing the second signal contact member 54. In FIG. 12, (a) shows a side view, (b) shows a plan view, (c) shows a view looking from the Y2 direction, and (d) shows a view looking from the Y1 direction. As shown in FIG. 12, the second signal contact member 54 includes a center part 54*a* having a bulge part, a contact part 54*b* of the Y1 side, and a second signal wire connecting part 54*c* of the Y2 side. In addition, the second signal wire connecting part 54*c* has an L shape in its cross section, and includes a horizontal plate part 54*c*l and a vertical side plate part 54*c*2. In addition, a bent crank part 54*d* is formed between the second signal wire connecting part 54*c* and the center part 54*a*, and the second signal wire connecting part 54*c* is slightly offset in the horizontal direction from the center part 54*a*.

As shown in FIG. 7, the first signal contact member 53 and the second signal contact member 54 are respectively fitted into holes 52*p* and 52*q* of the block body 52 by being pressed from the Y2 side.

Figure 13:
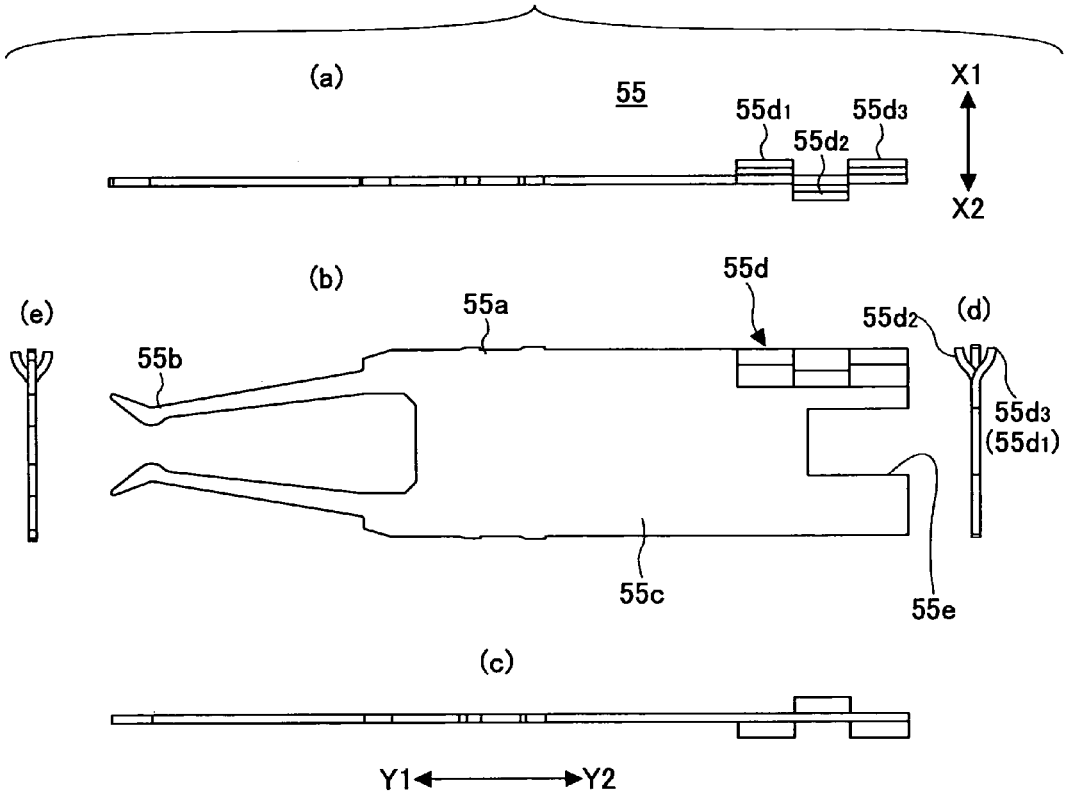
FIG. 13 is a diagram showing a ground contact member.

FIG. 13 is a diagram showing the-ground contact member 55. In FIG. 13, (a) shows a plan view, (b) shows a side view, (c) shows a bottom view, (d) shows a view looking from the Y2 direction, and (e) shows a view looking from the Y1 direction. As shown in FIG. 13, the ground contact member 55 has a plate shape. The ground contact members 55 sandwich the first and second signal contact members 53 and 54 therebetween and shield them. The ground contact member 55 includes a center part 55*a* having a bulge part, a contact part 55*b* having a fork shape of the Y1 side, a plate part 55*c* of the Y2 side, a drain wire connecting part 55*d*, and a notch 55*e* at the Y2 side end. The drain wire connecting part 55*d* includes three lugs 55*d*1, 55*d*2, and 55*d*3 at the Z1 and Y2 side ends of the ground contact member 55, and the three lugs 55*d*1, 55*d*2, and 55*d*3 are alternately bent in the X1 and X2 directions, and as shown in FIG. 13(*d*), form a U-letter.

As shown in FIG. 8, the ground contact member 55 is fitted into a hole 52*s* of the block body 52 by being pressed from the Y2 side.

In a state where the first signal contact members 53, the second signal contact members 54, and the ground contact members 55 are assembled in the block body 52, the first signal wire connecting parts 53*c*, the second signal wire connecting parts 54*c*, the plate parts 55*c*, and the drain wire connecting parts 55*d* are arrayed in the space 52*d* (refer to FIG. 4).

Figure 18:
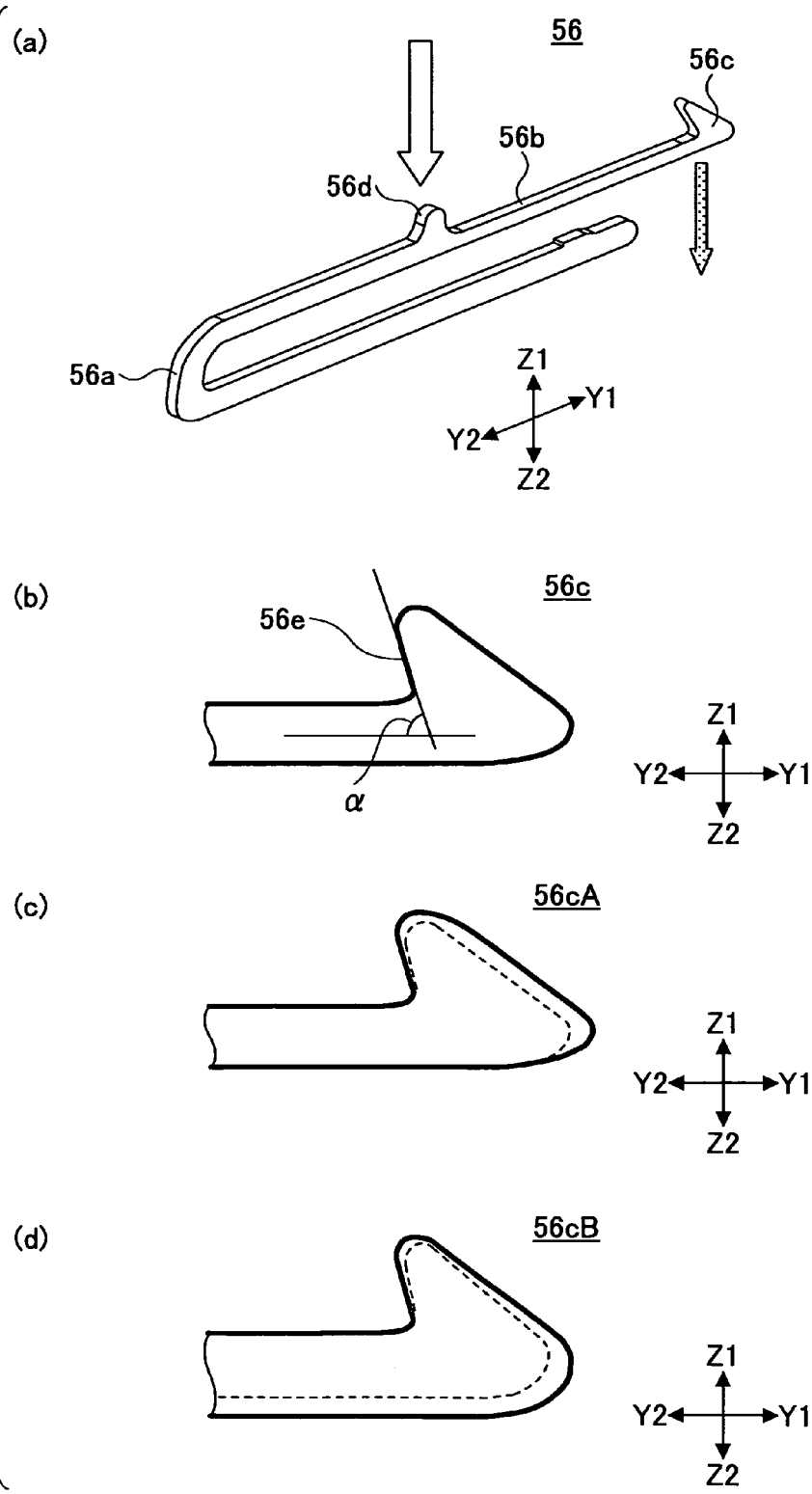
FIG. 18 is a diagram showing the locking arm member.

FIG. 18 is a diagram showing the locking arm member 56. In FIG. 18, (a) shows a perspective view of the locking arm member 56, (b) shows a hook 56*c* of the locking arm member 56, (c) shows a hook 56*c*A of the locking arm member 56, and (d) shows a hook 56*c*B of the locking arm member 56. The locking arm member 57 has a structure similar to that shown in FIG. 18.

As shown in FIGS. 4, 9, and 18, the locking arm member 56 includes a U-shaped part 56*a* at the Y2 side, an arm 56*b* being an upper part of the U-shaped part 56*a* elongated in the Y1 direction, a hook 56*c* at the end of the arm 56*b*, and a protrusion 56*d* at the Y2 side part of the arm 56*b*. The locking arm member 56 is secured to the block body 52 by inserting an end of the U-shaped part 56*a* into a hole 52*i* and by inserting the arm 56*b* into a groove 52*g*. The locking arm member 57 has the same shape as that of the locking arm member 56 and is similarly secured to the block body 52.

The hooks 56*c*A and 56*c*B are described below.

[Spacer Member 60]

Figure 14:
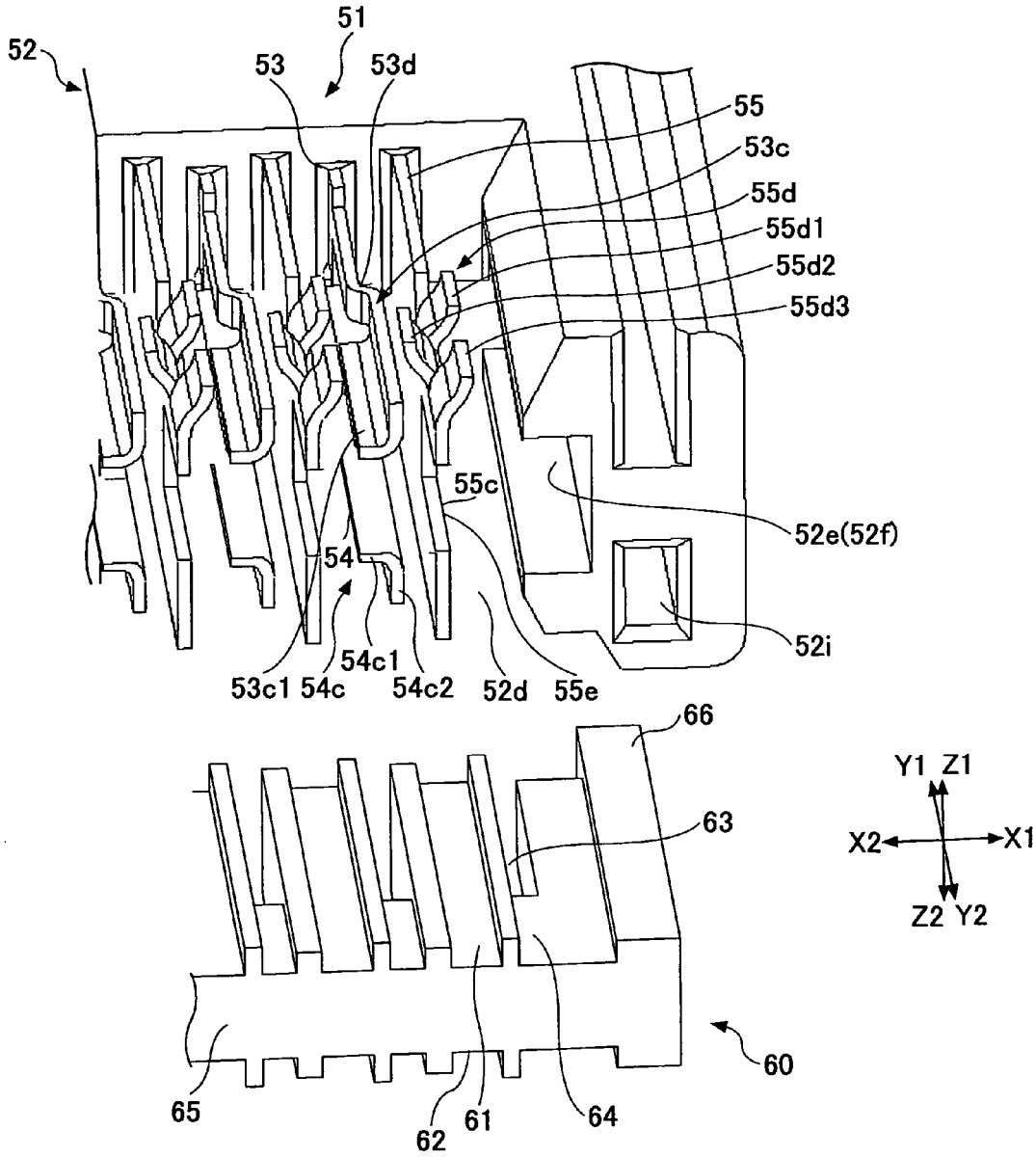
FIG. 14 is a perspective view showing the contact assembly body and the spacer member.
Figure 15:
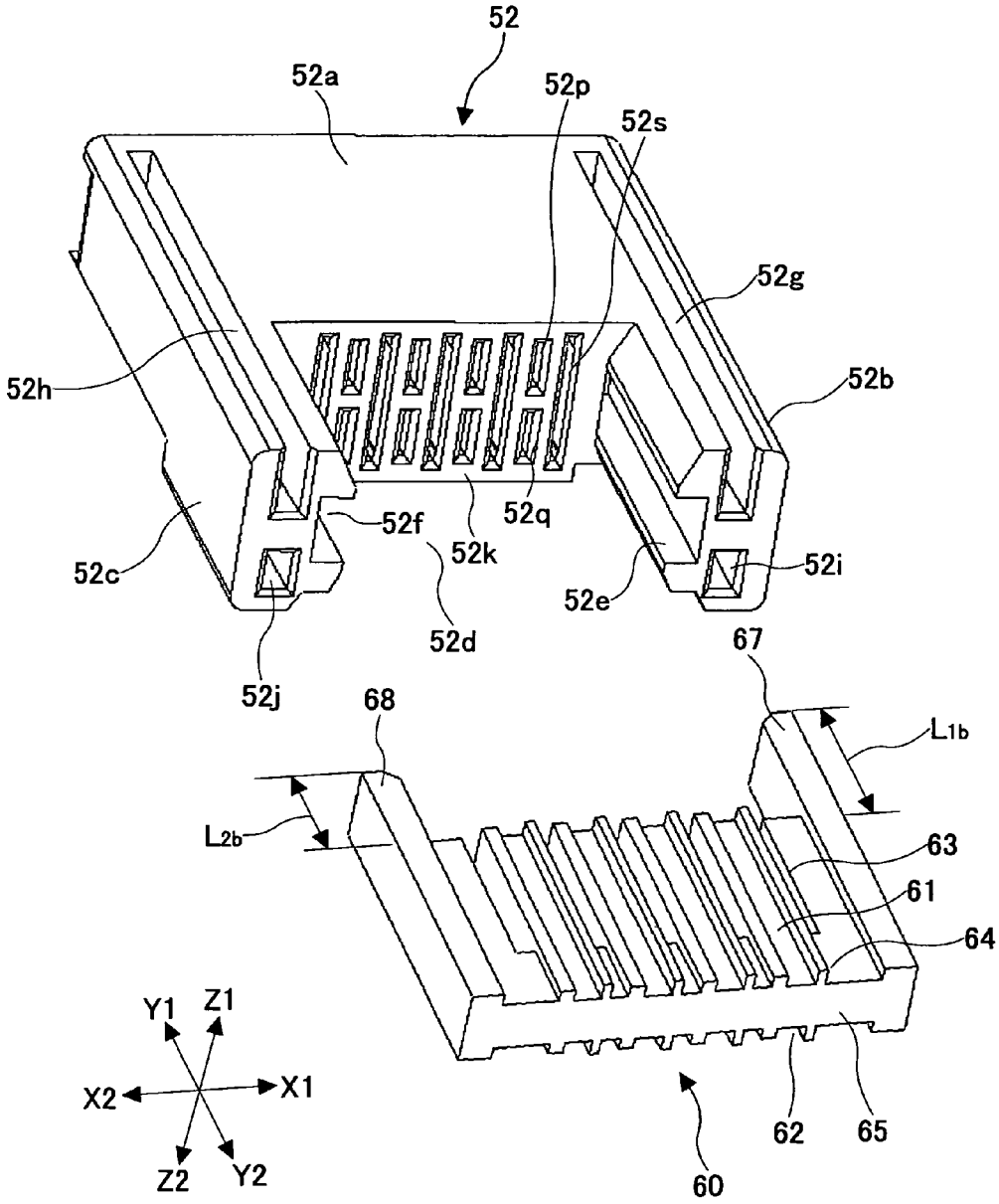
FIG. 15 is a perspective view showing a block body and the spacer member.

FIG. 14 is a perspective view showing the contact assembly body 51 and the spacer member 60. FIG. 15 is a perspective view showing the block body 52 and the spacer member 60. The spacer member 60 decides positions of the first and second signal wire connecting parts 53*c* and 54*c* and the drain wire connecting parts 55*d* (refer to FIGS. 11, 12, and 13) without being moved in the X1-X2 direction. As shown in FIGS. 14 and 15, the spacer member 60 is a plate-shaped member made of an electrically insulating resin and includes first grooves 61, second grooves 62, slits 63, and protrusion arms 67 and 68.

The first groove 61 has a shape corresponding to the shape of the first signal wire connecting part 53*c* (refer to FIG. 11), and is formed in a Z1 side face of the spacer member 60 elongated in the Y direction in the entire face thereof.

The second groove 62 has a shape corresponding to the shape of the second signal wire connecting part 54*c* (refer to FIG. 12), and is formed in a Z2 side face of the spacer member 60 elongated in the Y direction in the entire face thereof.

The first signal wire connecting part 53*c* and the second signal wire connecting part 54*c* have the same dimensions and are at the same positions in the X direction.

The slit 63 has a shape corresponding to the shape of the plate part 55*c* of the ground contact member 55 (refer to FIG. 13), and is formed by biting into places between the adjacent two first grooves 61 and between the adjacent two second grooves 62 from the Y1 side. A non-slit part 64 has a size corresponding to the size of the notch 55*e* of the ground contact member 55, and is formed between the end of the slit 63 and a Y2 side face 65 of the spacer member 60.

The protrusion arm 67 protrudes by a length L1*b* in the Y1 direction from the X1 side of the spacer member 60. The protrusion arm 68 protrudes by a length L2*b* in the Y1 direction from the X2 side of the spacer member 60. The length L1*b* of the protrusion arm 67 is different-from the length L2*b* of the protrusion arm 68, and L1*b*>L2*b*.

As shown in FIGS. 14 and 15, the spacer member 60 is attached to the block body 52 in a manner so that the first signal contact-members 53, the second signal contact members 54, and the ground contact members 55 are first assembled in the block body 52, and the protrusion arms 67 and 68 of the spacer member 60 are inserted into the end positions of the guide grooves 52*e* and 52*f*, respectively, in a state where the first signal wire connecting part 53*c*, the second signal wire connecting part 54*c*, the plate part 55*c*, and the drain wire connecting part 55*d* protrude in the space 52*d* by being arrayed. The spacer member 60 is more strongly attached to the block body 52 by inserting the protrusion arms 67 and 68 into the guide grooves 52*e* and 52*f* formed in the block body 52, compared with a case in which the spacer member 60 is attached to the block body 52 by engaging corresponding sides of the spacer member 60 with the arms 52*b* and 52*c* of the block body 52.

In FIG. 6, the spacer member 60 is attached to the block body 52. As shown in FIG. 6, the first signal wire connecting part 53*c* is inserted into the first groove 61 and is controlled not to move in the X1-X2 direction and the Z2 direction, and the second signal wire connecting part 54*c* is inserted into the second groove 61 and is controlled not to move in the X1-X2 direction and the Z1 direction. As shown in FIG. 10, in parts protruding to the space 52*d* of the ground contact member 55, the plate part 55*c* is inserted into the slit 63, and as shown in FIG. 8, the notch 55*e* is engaged in the non-slit part 64; therefore, the drain wire connecting part 55*d* is controlled not to move in the X1-X2 direction and the Z1-Z2 direction. Consequently, the plate part 55*c* and the drain wire connecting part 55*d* of the ground contact member 55 do not contact the first and second wire connecting parts 53*c* and 54*c*.

In addition, as shown in FIG. 10, the lengths L1*a* and L2*a* of the guide grooves 52*e*1 and 52*f*1 formed inside the block body 52 have a relation L1*a*>L2*a*, and the lengths L1*b* and L2*b* of the protrusion arms 67 and 68 have the relation L1*b*>L2*b*. Therefore, when it is attempted to insert the spacer member 60 in an inverted direction of its right and left sides, the spacer member 60 is prevented from being inserted. That is, by utilizing a structure in which the spacer member 60 is strongly attached to the block body 52, the spacer member 60 is prevented from being attached in the wrong direction.

[Connection of Pair of Wires 21]

As shown in FIG. 6, from the end of the pair of wires 21, the first and second covered signal wires 22-1 and 22-2 and the drain wire 25 are extended, and the covers at the tips of the first and second covered signal wires 22-1 and 22-2 are removed and first and second signal wires 23-1 and 23-2 being core wires are naked and exposed. The first signal wire 23-1 pairs up with the second signal wire 23-2.

As shown in FIGS. 5A and 6, the first signal wire 23-1 is connected by soldering to the first signal wire connecting part 53*c* whose position is controlled by the first groove 61, and the second signal wire 23-2 is connected by soldering to the second signal wire connecting part 54*c* whose position is controlled by the second groove 62. The drain wire 25 is connected by soldering to the drain wire connecting part 55*d* whose position is controlled by the slit 63. In FIGS. 5A and 5B, the reference number 70 is solder. As shown in FIG. 5B, since the first and second signal wire connecting parts 53*c* and 54*c* are L-shaped and have a corner, the first and second signal wires 23-1 and 23-2 are soldered to the first and second signal wire connecting parts 53*c* and 54*c*, respectively, in a manner so that positions inside the corners to which the first and second signal wires 23-1 and 23-2 are pushed are uniquely decided. In addition, since the drain wire connecting part 55*d* is U-shaped, the drain wire 25 is soldered to the drain wire connecting part 55*d* in a manner so that a position where the drain wire 25 is pushed is uniquely decided.

As described above, the first and second signal wires 23-1 and 23-2 are directly connected to the first and second signal contact members 53 and 54, respectively, without being connected via a relay board. Therefore, the crosstalk characteristic of the cable connector for balanced transmission 50 of the present invention is improved, compared with the conventional cable connector for balanced transmission.

The connecting method is not limited to soldering, and other connecting methods such as welding can be used.

In addition, in FIG. 5B, looking from the Y2 side, the respective positional relationships between the soldered first and second signal wires 23-1 and 23-2 and the contact parts 53*b* and 54*b* are shown; further, the positional relationship between the drain wire 25 and the contact part 55*b* is shown. In addition, as described above in FIG. 11, since the first signal wire connecting part 53*c* is slightly offset in the horizontal direction for the center part 53*a* by the bent crank part 53*d*, as shown in FIG. 5B, the soldered first signal wire 23-1 is arrayed with the contact part 53*b* in the Y1-Y2 direction. That is, the center line of the soldered first signal wire 23-1 coincides with the center line of the contact part 53*b*. Similarly, as described above in FIG. 12, since the second signal wire connecting part 54*c* is slightly offset in the horizontal direction for the center part 54*a* by the bent crank part 54*d*, as shown in FIG. 5B, the soldered second signal wire 23-2 is arrayed with the contact part 54*b* in the Y1-Y2 direction. That is, the center line of the soldered second signal wire 23-2 coincides with the center line of the contact part 54*b*. As shown in FIG. 5B, since the drain wire connecting part 55*d* is U-shaped, the drain wire 25 is arrayed with the contact part 55*b* in the Y1-Y2 direction.

In FIGS. 7 and 8, the reference number 71 is a sealing resin part, and the part of the space 52*d* remaining after connecting the cable for balanced transmission 20 to the contact assembly body 51 is filled with the sealing resin part 71, so that the sealing resin part 71 covers the first and second signal wires 23-1 and 23-2, the drain wire 25, the first and second signal wire connecting parts 53*c* and 54*c*, and the drain wire connecting part 55*d*. The spacer member 60 is secured to the block body 52 by the sealing resin part 71. Further, the first and second signal wires 23-1 and 23-2, the drain wire 25, the first and second signal wire connecting parts 53*c* and 54*c*, and the drain wire connecting part 55*d* are secured to the block body 52 by the sealing resin part 71. By the sealing resin part 71, the connections of the first and second signal wires 23-1 and 23-2 to the first and second signal wire connecting parts 53*c* and 54*c* are strengthened, and the connection of the drain wire 25 to the drain wire connecting part 55*d* is also strengthened.

[Shielding Cover Assembly Body 80]

As shown in FIGS. 4 and 7 through 9, the shielding cover assembly body 80 is composed of a first shielding cover 81 of the Z1 side and a second shielding cover 90 of the Z2 side. The first and second shielding covers 81 and 90 are formed by a metal plate by pressing. The contact assembly body 51 and the spacer member 60 are surrounded by the first and second shielding covers 81 and 90 when assembled.

As shown in FIG. 9, the hook 56*c* and the protrusion 56*d* of the locking arm member 56 and the hook 57*c* and the protrusion 57*d* of the locking arm member 57 protrude in the Z1 direction from openings of the first shielding cover 81.

As shown in FIG. 4, in the first shielding cover 81, protrusions 82 and 83 protruding in the Z1 direction are formed.

The end of the cable for balanced transmission 20 is clamped by a ring part 85 at the Y2 side of the first shielding cover 81.

[Hood 100 and Outer Cover 110]

As shown in FIG. 4, the hood 100 reinforcing the end of the cable connector for balanced transmission 50 is a soft component made of a resin and includes stretching parts 101 and 102 stretched like wings in the X1 and X2 directions at the Y1 end.

Further, as shown in FIG. 4, the outer cover 110 is a single soft component made of resin, has an approximate box shape whose Y1 and Y2 sides are openings, and includes an operating section 111 like a flap shape in the Z1 side face and notches 112 and 113 at the Y1 side of the operating section 111.

Next, an inserting method of the cable for balanced transmission 20 is explained.

First, the cable for balanced transmission 20 is inserted into the hood 100 and the outer cover 110, and tips of the cable for balanced transmission 20 are soldered to the first and second signal wire connecting parts 53*c* and 54*c* and the drain wire connecting parts 55*d* whose positions are decided by the spacer member 60 and the block body 52. Next, the hood 100 is positioned near the ring part 85 of the first shielding cover 81 by being moved along the cable for balanced transmission 20. Then, the outer cover 110 is moved along the cable for balanced transmission 20, and the cable for balanced transmission 20 is engaged in the shielding cover assembly body 80 via the ring part 85 from the Y2 side.

Figure 16:
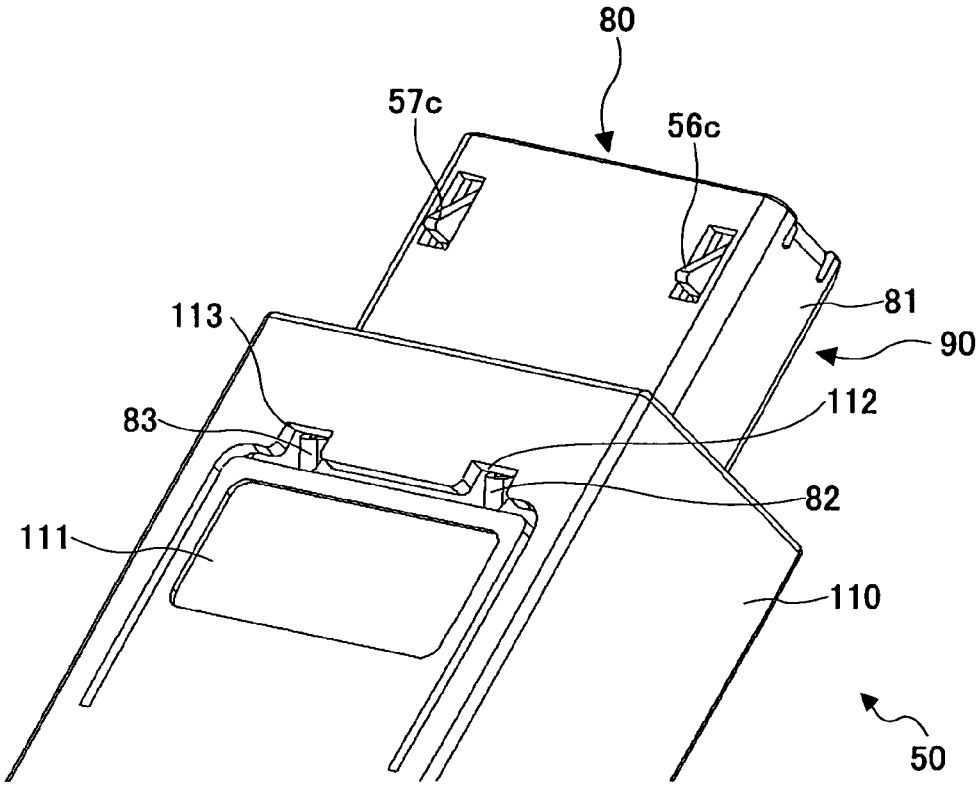
FIG. 16 is a perspective view showing a tip part of the cable connector for balanced transmission.
Figure 17:
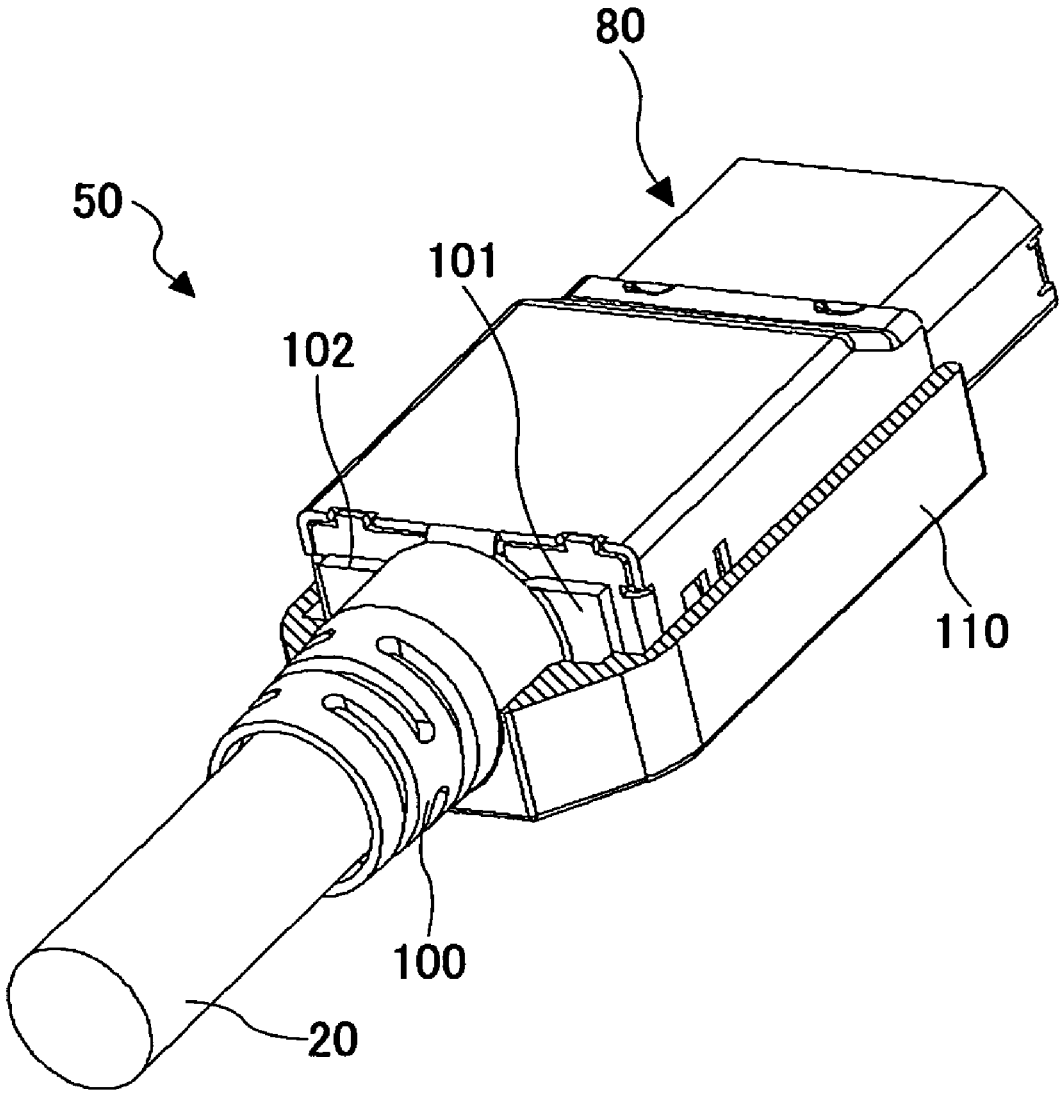
FIG. 17 is a perspective view showing the cable connector for balanced transmission to which a hood and an outer cover are attached.

FIG. 16 is a perspective view showing a tip part of the cable connector for balanced transmission 50. As shown in FIGS. 4, 7, and 16, the protrusions 82 and 83 of the first shielding cover 81 are respectively inserted into the notches 112 and 113 of the outer cover 110 and the shielding cover assembly body 80 is prevented from being moved in the Y2 direction. FIG. 17 is a perspective view showing the cable connector for balanced transmission 50 to which the hood 100 and the outer cover 110 are attached. As shown in FIG. 17, the stretching parts 101 and 102 of the hood 100 are stopped by the outer cover 110 and the hood 100 is prevented from being moved in the Y2 direction.

As shown in FIG. 9, the operating section 111 of the outer cover 110 is positioned right above the protrusions 56*d* and 57*d* of the locking arm members 56 and 57. Therefore, when the operating section 111 is pushed, the protrusions 56*d* and 57*d* are pushed, the arms 56*b* and 57*d* are bent, and the hooks 56*c* and 57*c* are pushed down. With this, the cable connector for balanced transmission 50 can be unlocked from a connector of an apparatus by unlocking the locking arm members 56 and 57.

In this, the first signal contact member 53 can dispose its contact part at the Y2 side, the second signal contact member 54 can dispose its contact part at the Y2 side, and the ground contact member 55 can dispose its fork-shaped contact part at the Y2 side; further, a relay board can be used instead of using the spacer member 60 and the relay board is engaged by the guide grooves 52*e* and 52*f*. This structure is possible.

[Hook 56*c* of Locking Arm Member 56]

Referring to FIG. 18, the hook 56*c* of the locking arm member 56 is explained in detail. As shown in FIG. 18(*b*), the hook 56*c* has a shape in which an edge 56*e* of the hook 56*c* at the Y2 side has an angle a being an acute angle between the Y axis and the edge 56*e*. In other words, the edge 56*e* is slanted in the Y2 direction.

The cable connector for balanced transmission 50 is connected to a connector of an apparatus and is locked by inserting the hook 56*c* into a slit of the connector of the apparatus. The sustaining strength of the locking state is high when the cable connector for balanced transmission 50 is connected to a connector on a circuit board of an apparatus with the angle a being an acute angle (refer to FIG. 32).

As described above, in FIG. 18(*c*), the hook 56*c*A is shown, and in FIG. 18(*d*), the hook 56*c*B is shown. The hook 56*c*A has a thicker shape in the Y1 direction than the hook 56*c* shown by a broken line. The hook 56*c*B has a thicker shape in the Z2 direction than the hook 56*c* shown by the broken line. The strength of the hooks 56*c*A and 56*c*B is greater than that of the hook 56*c*.

Second Embodiment

Figure 19:
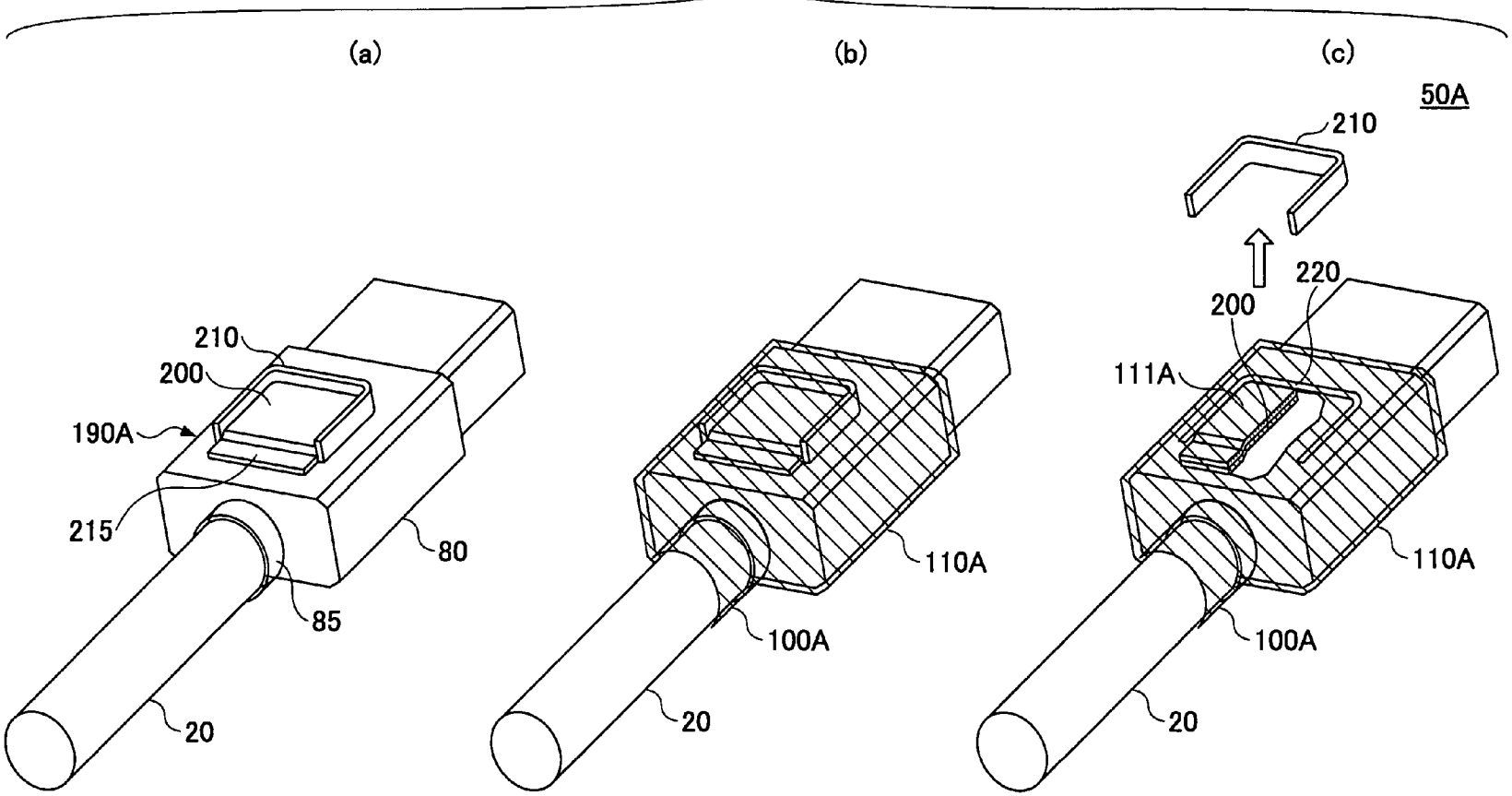
FIG. 19 is a perspective view of a cable connector for balanced transmission according to a second embodiment of the present invention.

FIG. 19 is a perspective view of a cable connector for balanced transmission 50A according to a second embodiment of the present invention. The cable connector for balanced transmission 50A includes an outer cover 110A and a hood 100A which are formed by potting a resin and an operating section 111A reinforced by a reinforcing plate member 200.

The cable connector for balanced transmission 50A is manufactured by the following processes. In FIG. 19, (a), (b), and (c) show the processes.

First, a cable connector main body 190A is assembled by surrounding the contact assembly body 51 (not shown) and the spacer member 60 (not shown) with the use of the shielding cover assembly body 80 and further by clamping the end of the cable for balanced transmission 20 with the ring part 85. These processes are the same as those in the first embodiment.

Next, as shown in FIG. 19(*a*), a reinforcing plate member 200 covers the protrusions 56*d* and 57*d* of the locking arm member 56 and 57 (refer to FIG. 9), and a component 210 for forming a U-shaped slit runs along three sides of the reinforcing plate member 200, and further, a partitioning component 215 runs along the fourth side of the plate member 200.

Then, as shown in FIG. 19(*b*), the outer cover 110A and the hood 100A are formed in an integrated manner by applying potting of a resin so that the shielding cover assembly body 80 is covered. In this, the outer cover 110A covers the cable connector main body 190A and the hood 100A covers the ring part 85.

Further, as shown in FIG. 19(*c*), the component 210 is removed. With this, a U-shaped slit 220 is formed around the operating section 111A, and the operating section 111A is formed by being reinforced by the reinforcing plate member 200.

Third Embodiment

Figure 20:
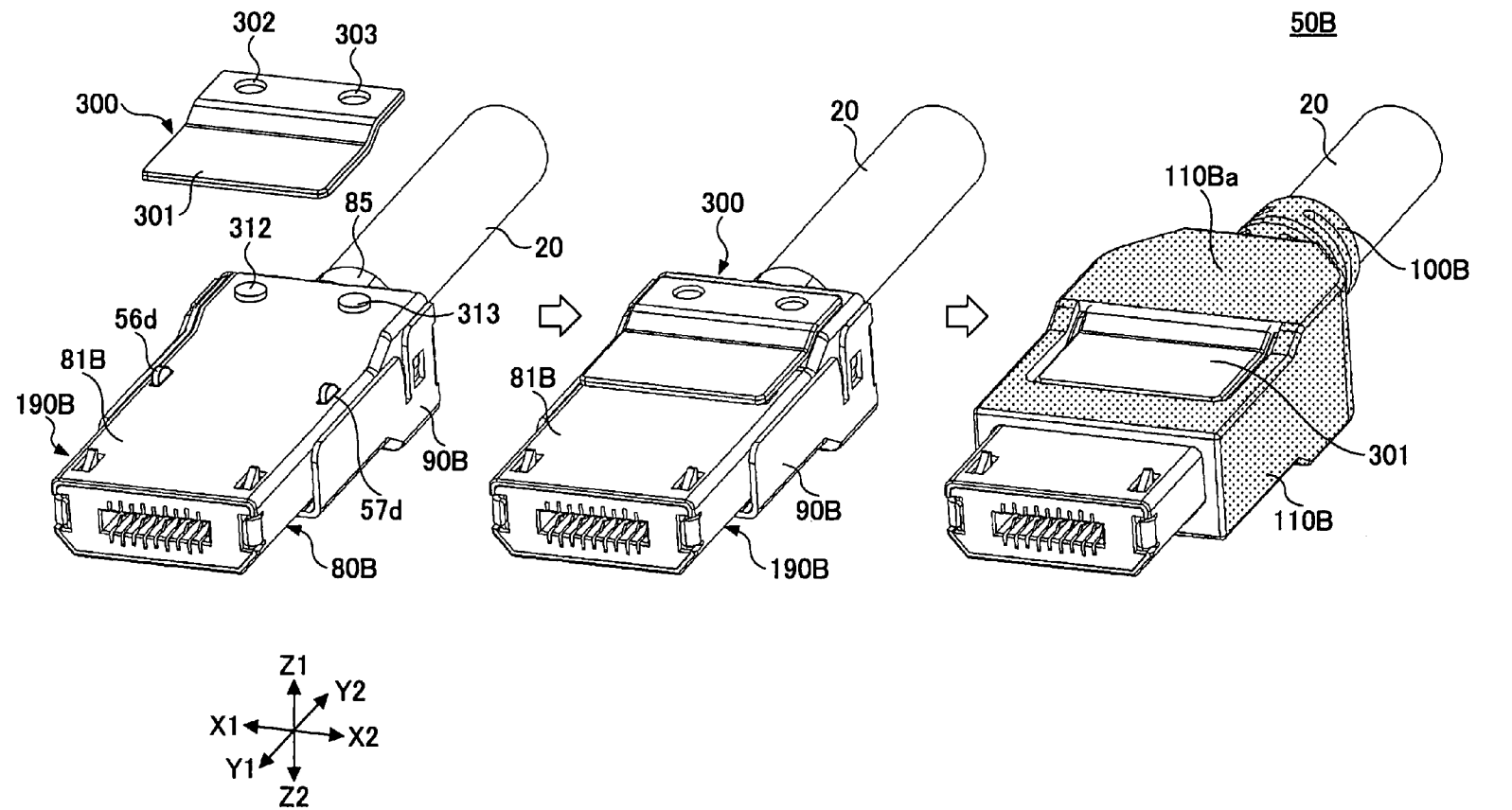
FIG. 20 is a perspective view of a cable connector for balanced transmission according to a third embodiment of the present invention.
Figure 21:
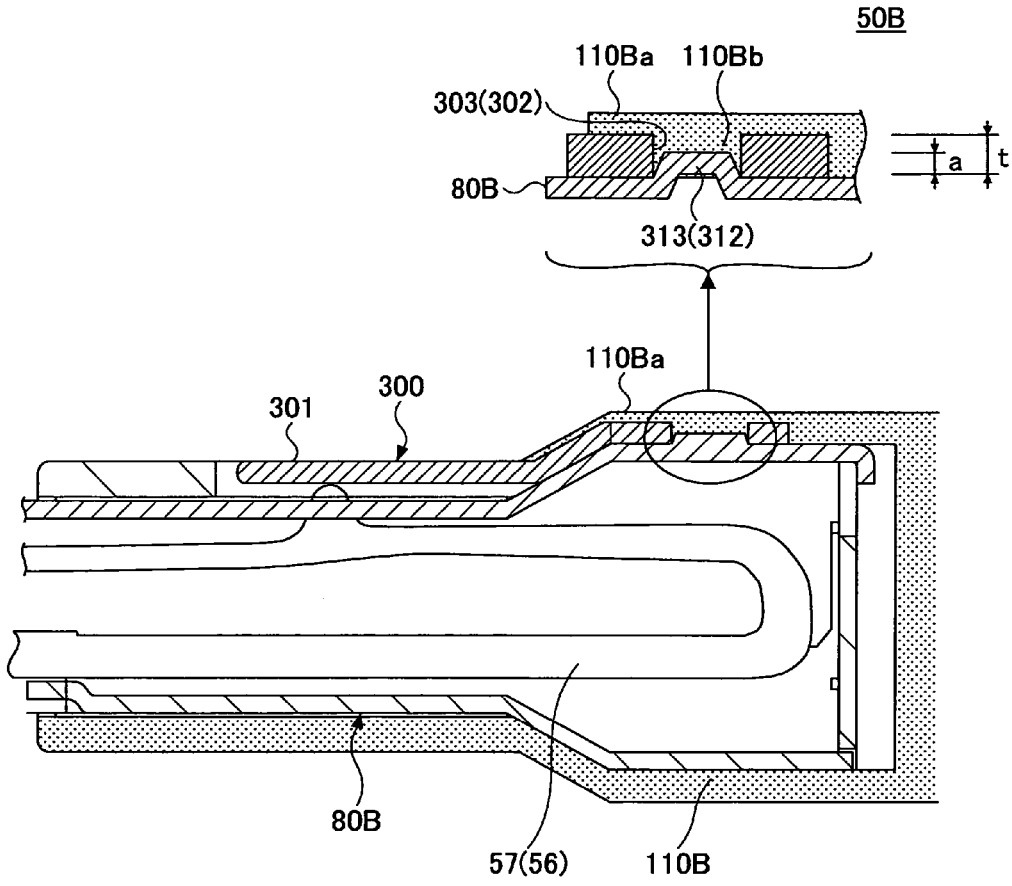
FIG. 21 is a cross-sectional view of a part of the cable connector for balanced transmission shown in FIG. 20.

FIG. 20 is a perspective view of a cable connector for balanced transmission 50B according to a third embodiment of the present invention. The cable connector for balanced transmission 50B includes an outer cover 110B and a hood 100B which are formed by outsert molding and an operating section 301 formed by an operating section member 300. FIG. 21 is a cross-sectional view of a part of the cable connector for balanced transmission 50B shown in FIG. 20.

The cable connector for balanced transmission 50B is manufacture by the following processes. In FIG. 20, (a), (b), and (c) show the processes.

As shown in FIG. 20(*a*), the operating section member 300 is a plate-shaped member and includes the operating section 301 at the Y1 side and two openings 302 and 303 at the Y2 side. In addition, a shielding cover assembly body 80B includes two protrusions 312 and 313 in the upper face. The height "a" of the protrusions 312 and 313 is less than the thickness "t" of the operating section member 300 (refer to FIG. 21).

As shown in FIG. 20(*b*), first, a cable connector main body 190B is assembled by surrounding the contact assembly body 51 (not shown) and the spacer member 60 (not shown) with a shielding cover assembly body 80B and further by clamping the end of the cable for balanced transmission 20 with the ring part 85. These processes are the same as those in the first embodiment. The shielding cover assembly body 80B is composed of a first shielding cover 81B and a second shielding cover 90B.

As shown in FIG. 20(*b*), the operating section member 300 is attached on the shielding cover assembly body 80B by engaging the openings 302 and 303 with the protrusions 312 and 313, respectively, in a manner so that the operating section member 300 covers the protrusions 56*d* and 57*d* of the locking arm members 56 and 57 (refer to FIG. 9).

Next, the above semi-assembled item is placed in a forming die and outsert molding is applied. As shown in FIG. 20(*c*), the outer cover 110B and the hood 100B are formed in an integrated manner by the outsert molding. In this, the outer cover 110B covers the cable connector main body 190B and the hood 100B covers the ring part 85.

When taking out the above outsert molding item from the forming die, the cable connector for balanced transmission 50B is completed.

In the outsert molding, a resin does not cover the upper face and edge parts of the operating section 301 of the operating section member 300. As shown in FIG. 21, a resin part 110B*a* of the outer cover 110B covers the Y2 side part of the operating section member 300 and a resin part 110B*b* of the outer cover 110B fills the openings 302 and 303. The operating section member 300 is secured on the shielding cover assembly body 80B by the resin parts 110B*a* and 110B*b*.

Fourth Embodiment

Figure 22:
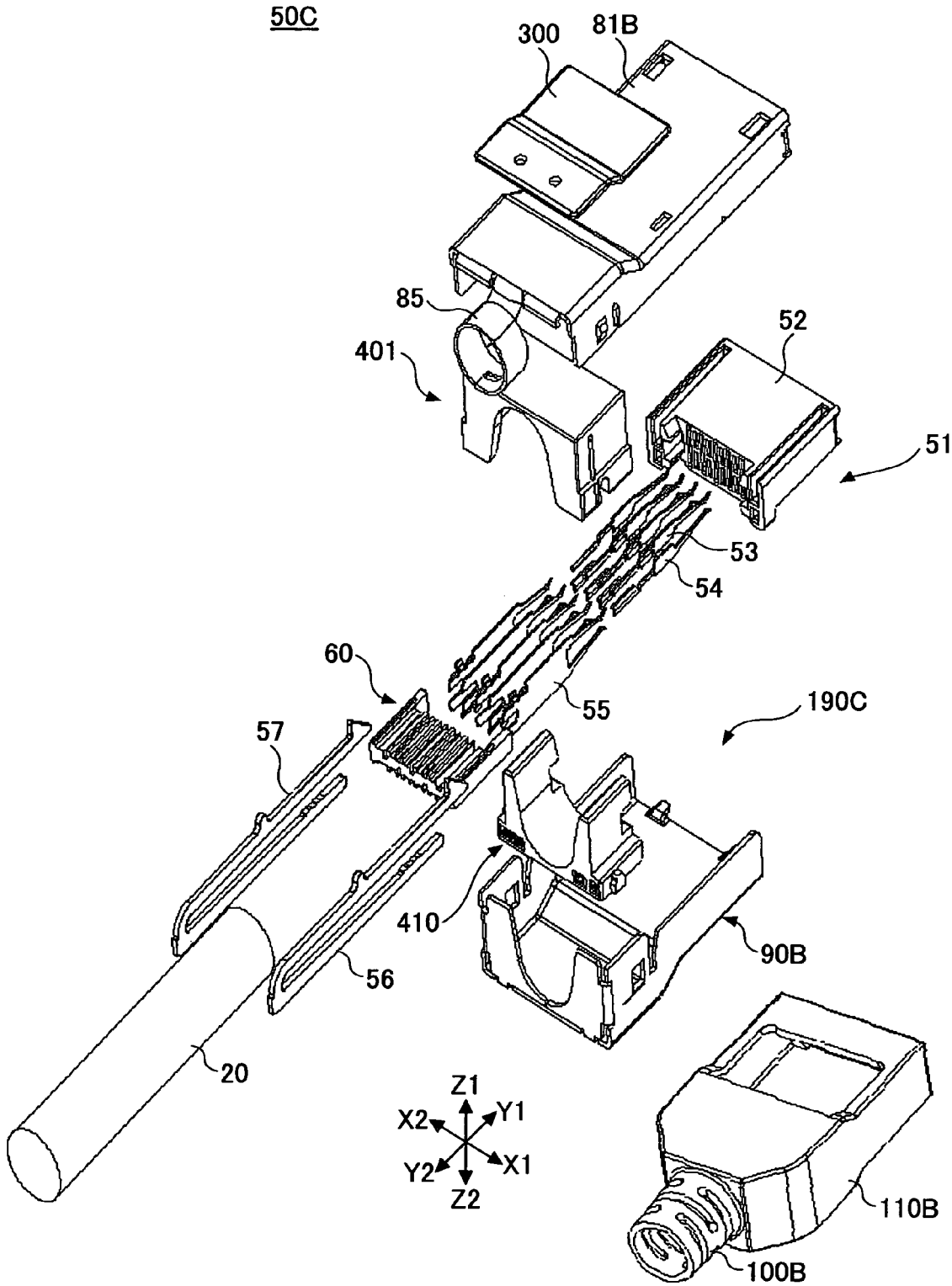
FIG. 22 is an exploded perspective view of a cable connector for balanced transmission according to a fourth embodiment of the present invention.
Figure 23:
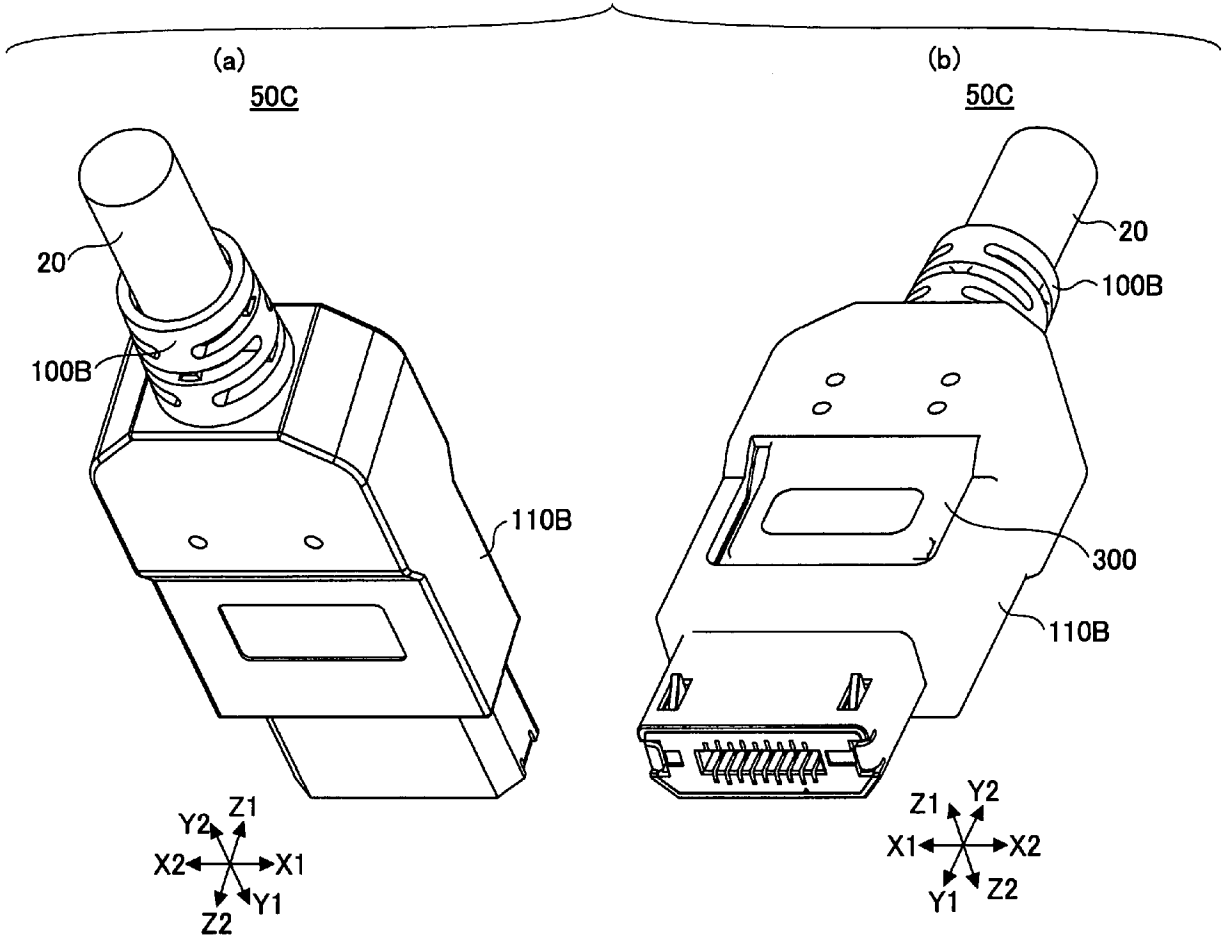
FIG. 23 is a perspective view of the cable connector for balanced transmission shown in FIG. 22.
Figure 24:
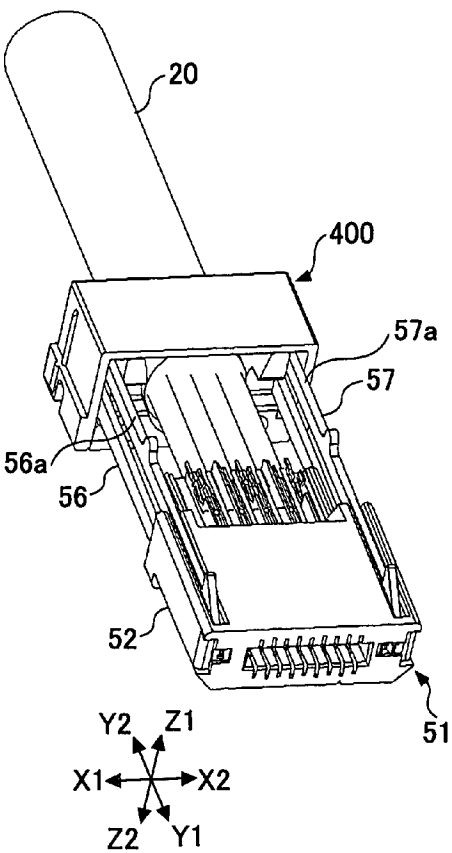
FIG. 24 is a perspective view of the cable connector for balanced transmission shown in FIG. 23 where a shielding cover assembly body is removed.
Figure 24:
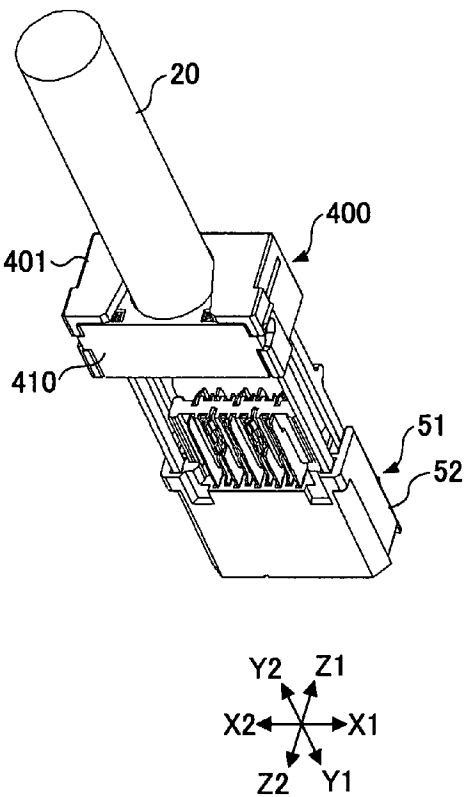

FIG. 22 is an exploded perspective view of a cable connector for balanced transmission 50C according to a fourth embodiment of the present invention. FIG. 23 is a perspective view of the cable connector for balanced transmission 50C. In FIG. 23, (a) shows a view looking from the Z2 and Y2 sides and (b) shows a view looking from the Z1 and Y1 sides. FIG. 24 is a perspective view of the cable connector for balanced transmission 50C with the shielding cover assembly body 80B removed. In FIG. 24, (a) shows a view looking from the Z2 and Y2 sides and (b) shows a view looking from the Z1 and Y1 sides.

In the cable connector for balanced transmission 50C according to the fourth embodiment, in addition to the cable connector for balanced transmission 50B according to the third embodiment, an inner cap 400 is newly added. The inner cap 400 prevents resin from flowing into the shielding caver assembly body 80B when the outer cover 110B and the hood 100B are formed by the outsert molding.

The shielding cover assembly body 80B has an opening into which the cable for balanced transmission 20 is inserted at the Y2 side. Therefore, it is likely that resin flows into the shielding cover assembly body 80B from the Y2 side at the time of the outsert molding. In order to avoid this, the inner cap 400 is disposed at the Y2 side of the shielding cover assembly body 80B.

Figure 25:
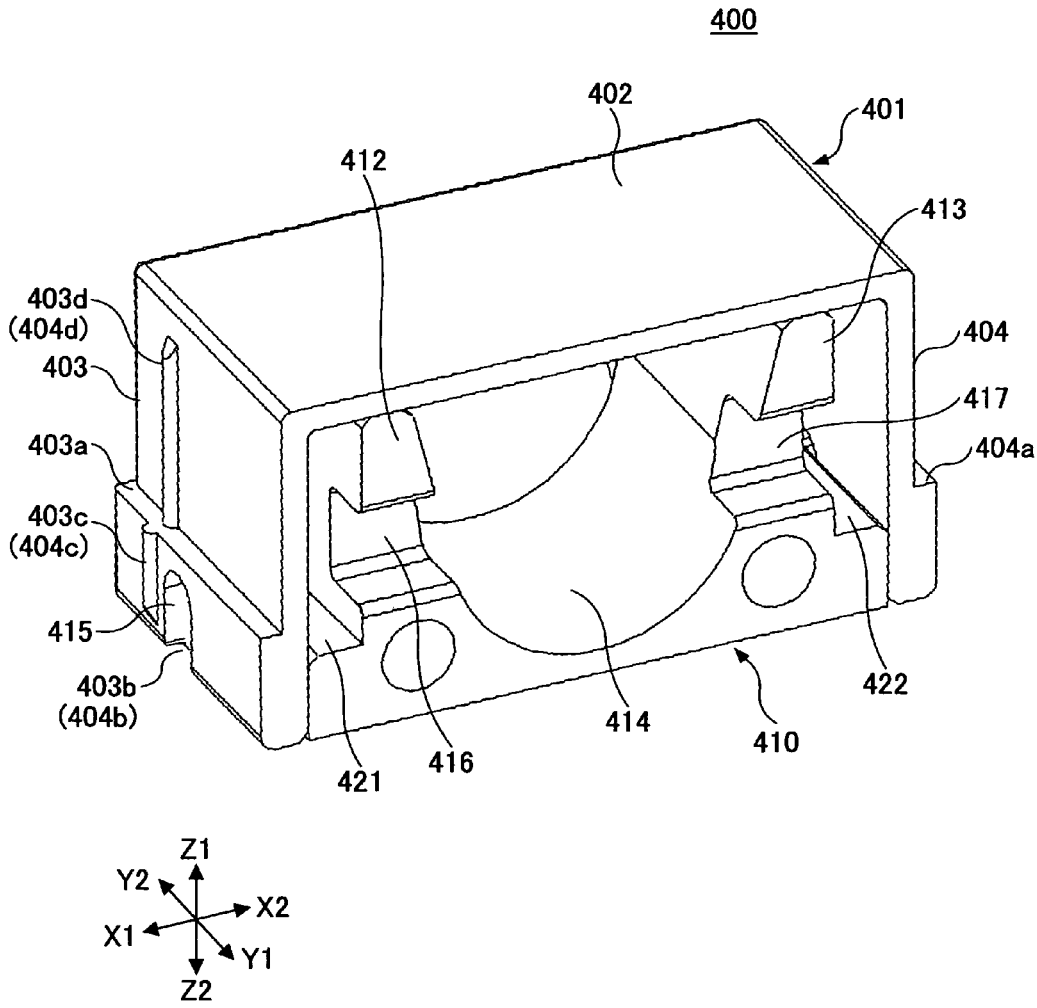
FIG. 25 is a perspective view of an inner cap shown in FIG. 22.
Figure 26:
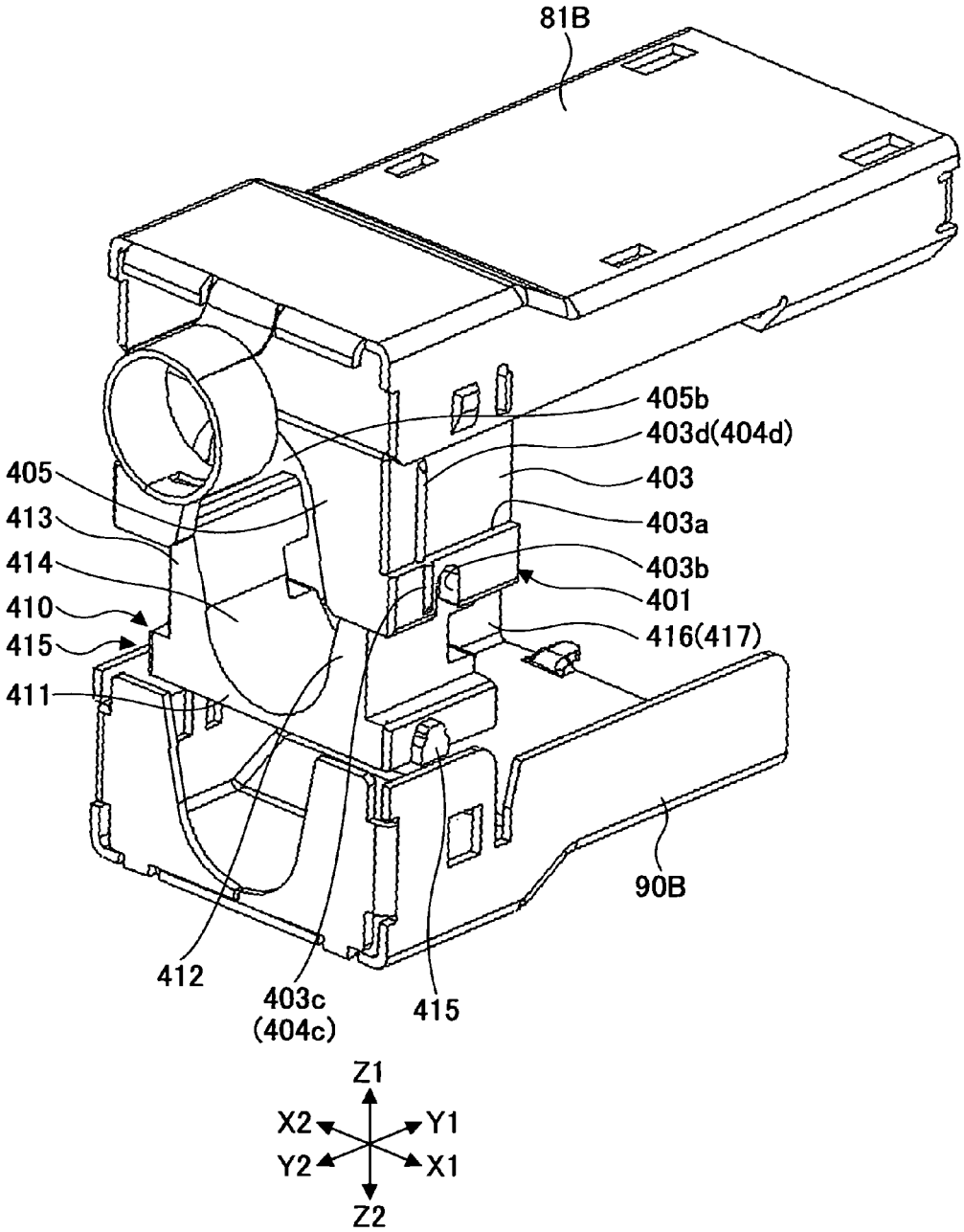
FIG. 26 is an exploded perspective view of the inner cap and the shielding cover assembly body.

FIG. 25 is a perspective view of the inner cap 400. FIG. 26 is an exploded perspective view of the inner cap 400 and the shielding cover assembly body 80B. As shown in FIG. 26, the inner cap 400 has a structure in which a first inner cap half 401 of the Z1 side and a second inner cap half 402 of the Z2 side are combined and both halves are made of molded resin. The inner cap 400 is disposed at the Y2 end in the shielding cover assembly body 80B, that is, at the part through which the cable for balanced transmission 20 is inserted in the shielding cover assembly body 80B, and the inner cap 400 closes a gap at the Y2 end between the shielding cover assembly body 80B and the cable for balanced transmission 20.

As shown in FIG. 26, the second inner cap half 410 is an approximate U-shaped member and includes a base part 411, and rising parts 412 and 413 rising from the X1 and X2 sides, respectively, of the base part 411 in the Z1 direction. A space 414 is formed between the rising parts 412 and 413. Protrusions 415 are formed at both end faces of the X1 and X2 sides of the base part 411. Concave parts 416 and 417 engaging the spacer member 60 (refer to FIG. 22) are formed at the Y1 sides of the rising parts 412 and 413, respectively.

As shown in FIG. 25, the first inner cap half 401 includes an upper plate part 402, side plate parts 403 and 404 of the X1 and X2 sides, respectively, and a back plate part 405 of the Y2 side(refer to FIG. 26). The side plate part 403 includes a step part 403*a* in the middle, a notch 403*b* at the Z2 end, and ribs 403*c* and 403*d* on the outer face; the side plate part 404 includes a step part 404*a* in the middle, a notch 404*b* at the Z2 end, and ribs 404*c* and 404*d* on the outer face. A window 405*b* having an approximate semicircular shape is formed in the back plate part 405 (refer to FIG. 26).

The protrusions 415 of the second inner cap half 410 are inserted into the notches 403*b* and 404*b* by being pressed. The ribs 403*c* and 403*d* and the ribs 404*c* and 404*d* are elongated as straight lines in the Z1-Z2 direction formed for the approximate entire lengths on the side plates 403 and 404, respectively. The ribs 403*c* and 404*c* are formed so that the ribs 403*c* and 404*c* press the inside walls of the second shielding cover 90B. The ribs 403*d* and 404*d* are formed so that the ribs 403*d* and 404*d* press the inside walls of the first shielding cover 81B.

A cable connector main body 190C is assembled by surrounding the contact assembly body 51 and the spacer member 60 with the shielding cover assembly body 80B, in which the inner cap 400 is formed and by further clamping the end of the cable for balanced transmission 20 with the ring part 85.

The cable connector for balanced transmission 50C is formed by forming the outer cover 110B and the hood 100B on the cable connector main body 190C by outsert molding.

Figure 27:
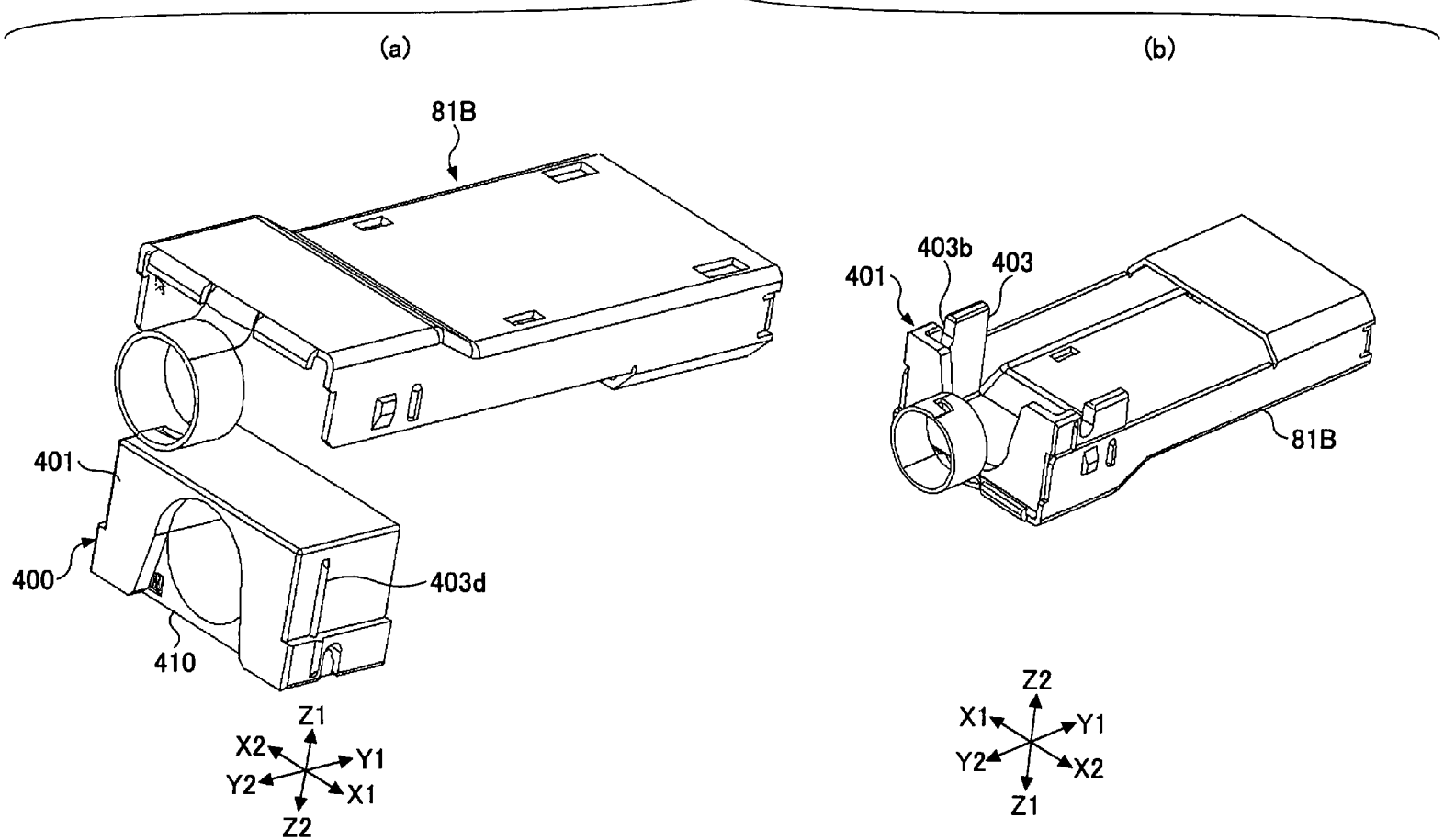
FIG. 27 is a perspective view showing the inner cap and a first shielding cover.

FIG. 27 is a perspective view showing the inner cap 400 and the first shielding cover 81B. In FIG. 27, (a) shows a first process of assembling the inner cap 400 and the first shielding cover 81B, and (b) shows a second process of assembling the inner cap 400 and the first shielding cover 81B.

As shown in FIGS. 22 through 27, the first inner cap half 401 is pushed into the first shielding cover 81B, the contact assembly body 51 to which the tips of the cable for balanced transmission 20 are connected is assembled in the first inner cap half 401, and the inner cap 400 is assembled by combining the second inner cap half 410 with the first inner cap half 401. Further, the second shielding cover 90B is engaged with the first shielding cover 81B by covering the second inner cap half 410. In addition, the end of the cable for balanced transmission 20 is clamped by the ring part 85. With the above processes, the cable connector main body 190C is assembled.

In the middle of the assembly of the cable connector main body 190C, the protrusions 415 of the second inner cap half 410 are inserted into the notches 403*b* and 404*b* of the first inner cap half 401. Since the cable for balanced transmission 20 before being clamped is tentatively secured to the inner cap 400, the cable connector main body 190C can be easily assembled.

Figure 28:
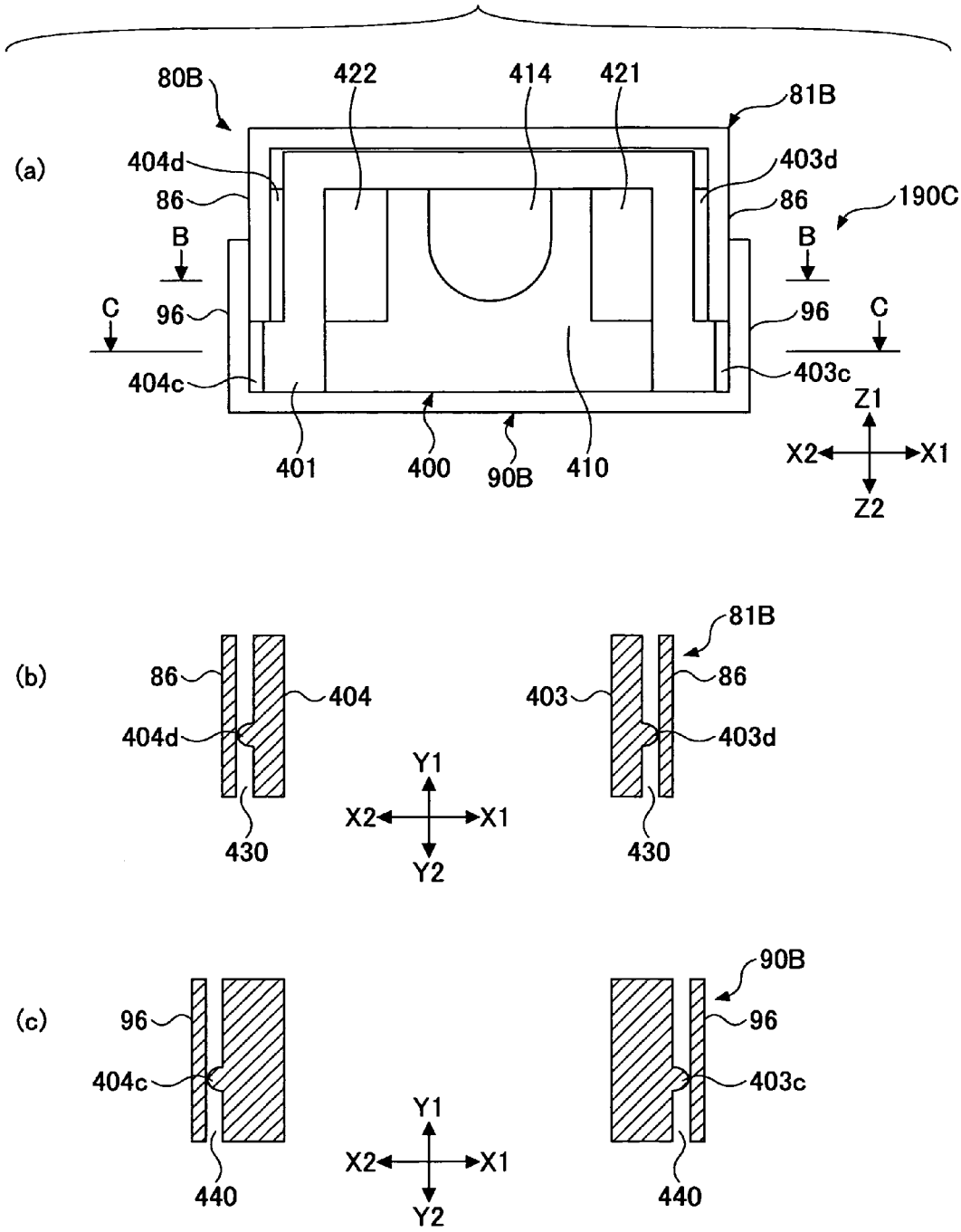
FIG. 28 is a schematic diagram where gaps between the X1 and X2 sides of the inner cap and the shielding cover assembly body are closed.

FIG. 28 is a schematic diagram showing where gaps between the X1 and X2 sides of the inner cap 400 and the shielding cover assembly body 80B are closed. In FIG. 28, (a) shows a diagram in which the cable connector main body 190C is viewed from the Y2 side, (b) shows a cross-sectional view of the cable connector main body 190C shown in FIG. 28(*a*) along line B—B of FIG. 28(*a*), and (*c*) shows a cross-sectional view of the cable connector main body 190C shown in FIG. 28(*a*) along line C—C of FIG. 28(*a*).

As shown in (a) and (c) of FIG. 28, gaps 440 between the X1 and X2 sides of the inner cap 400 (401) and both side plates 96 of the second shielding cover 90B are closed by pressing the ribs 403*c* and 404*c* against the inside walls of the side plates 96 of the second shielding cover 90B. As shown in (a) and (b) of FIG. 28, gaps 430 between the X1 and X2 sides of the inner cap 400 (401) and both side plates 86 of the first shielding cover 81B are closed by pressing the ribs 403*d* and 404*d* against the inside walls of the side plates 86 of the first shielding cover 81B. The space 414 is filled with plural pairs of wires 21.

Therefore, resin is prevented from flowing into the inside of the shielding cover assembly body 80B from the Y2 side at the time of outsert molding by the existence of the inner cap 400.

As shown in FIGS. 25 and 28(*a*), spaces 421 and 422 are formed inside the inner cap 400 at the X1 and X2 sides. As shown in FIG. 24(*b*), the U-shaped parts 56*a* and 57*a* of the locking arm members 56 and 57 are fitted into the spaces 421 and 422.

Figure 29:
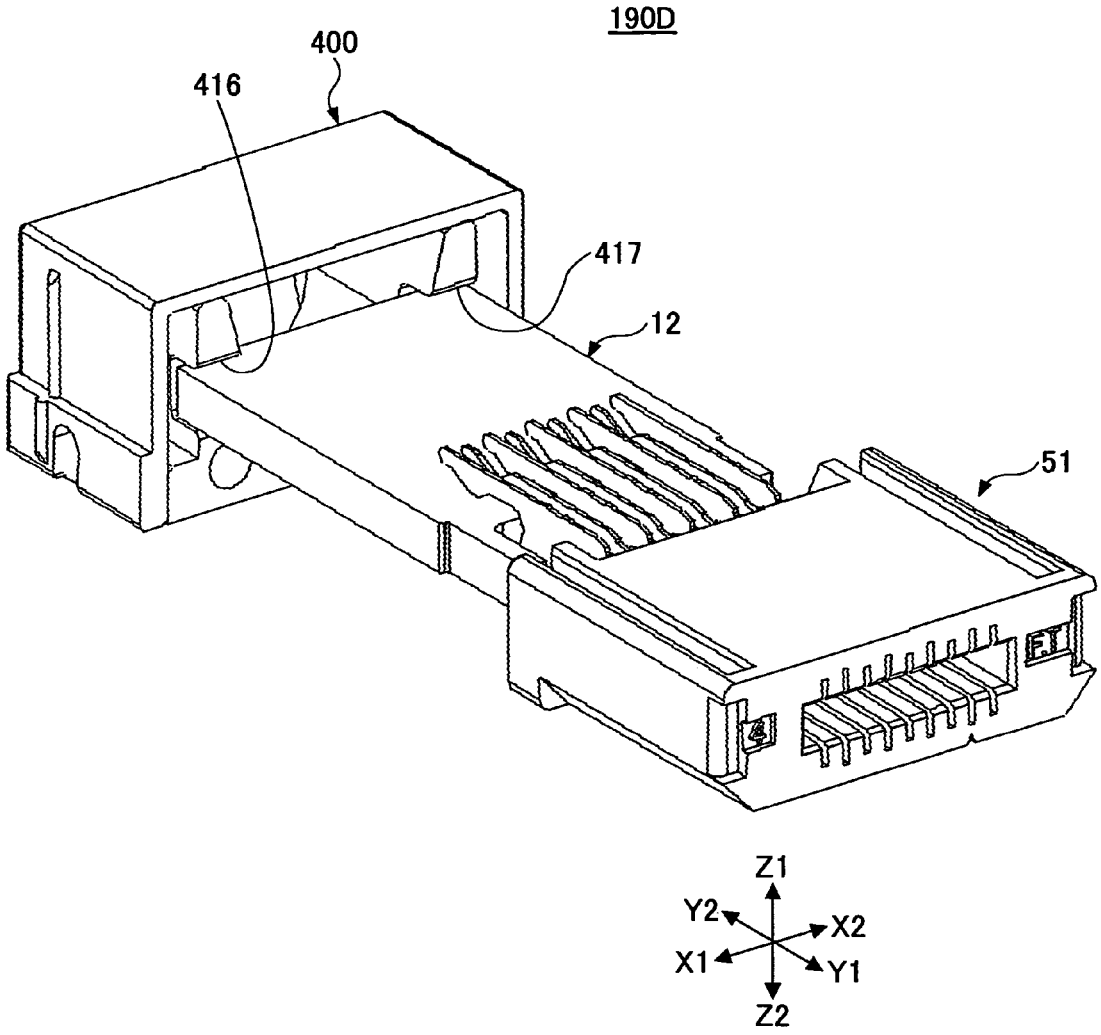
FIG. 29 is a perspective view of a cable connector main body in which a relay board is used.

FIG. 29 is a perspective view of a cable connector main body 190D in which the relay board 12 is used. The relay board 12 is shown in FIG. 1. Edges of the relay board 12 are inserted to the concave parts 416 and 417 of the rising parts 412 and 413 (refer to FIG. 26) of the second inner cap half 410. With this, the relay board 12 is supported.

Fifth Embodiment

Figure 30:
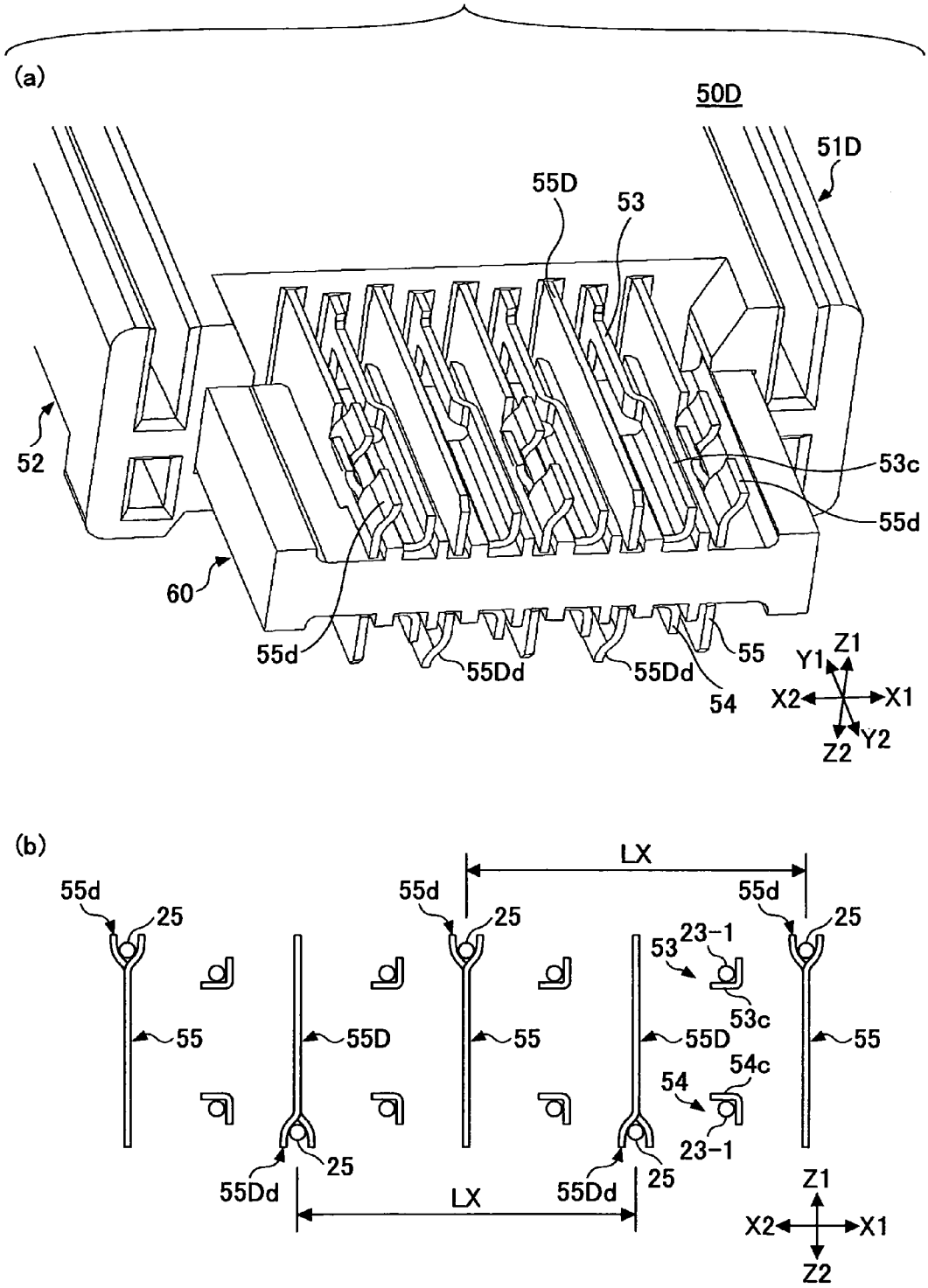
FIG. 30 is a diagram showing a part of a cable connector for balanced transmission according to a fifth embodiment of the present invention.

FIG. 30 is a diagram showing a part of a cable connector for balanced transmission 50D according to a fifth embodiment of the present invention. In FIG. 30, (a) shows a perspective view of the part of the cable connector for balanced transmission 50D, and (b) shows a state in which the first signal contact member 53, the second signal contact member 54, the ground contact member 55, and a ground contact member 55D are arrayed.

As shown in FIG. 30, in a contact assembly body 51D, the ground contact member 55 is disposed at one side of the first signal contact member 53 and the second signal contact member 54, and the ground contact member 55D is disposed at the other side of the first signal contact member 53 and the second signal contact member 54 in the block body 52. The ground contact member 55D has the same shape as that of the ground contact member 55, exceptionally that the ground contact member 55D is disposed upside down.

As shown in FIG. 30, the ground contact members 55 and 55D are alternately arrayed. The ground contact member 55 has the drain wire connecting part 55*d* at the Z1 side, and the ground contact member 55D has a drain wire connecting part 55Dd at the Z2 side.

As shown in FIG. 30(*b*), the drain wire connecting parts 55*d* and 55Dd are alternately arrayed up and down. Therefore, the interval LX between the drain wire connecting parts 55*d* (55Dd) becomes twice as long as the interval of the case in which only the drain wire connecting parts 55*d* are arrayed. Consequently, it becomes easy to solder the tips of the pair of wires 21 to the drain wire connecting parts 55*d* (55Dd).

Sixth Embodiment

Figure 31:
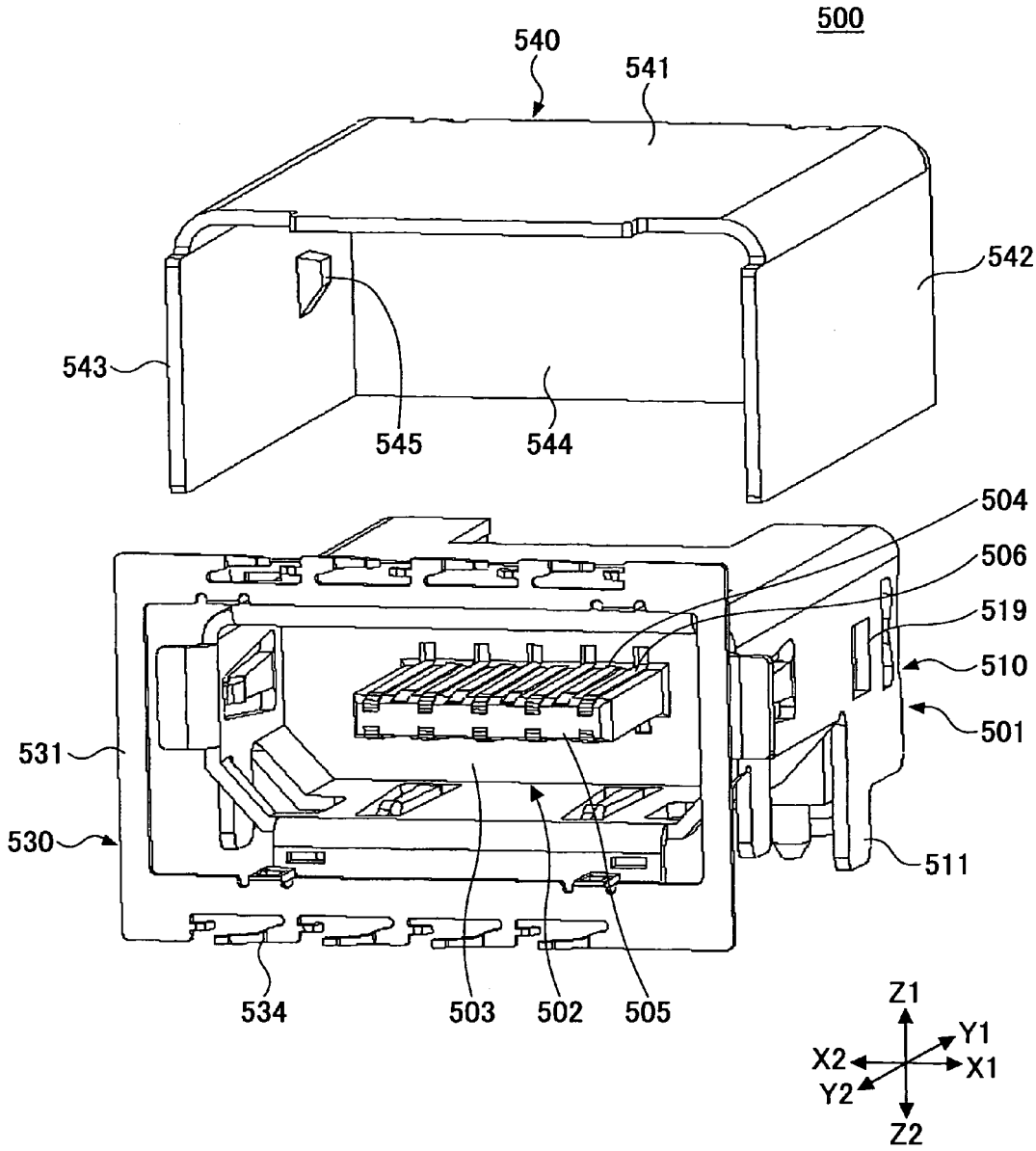
FIG. 31 is a perspective view of a connector for a printed circuit board according to a sixth embodiment of the present invention.
Figure 32:
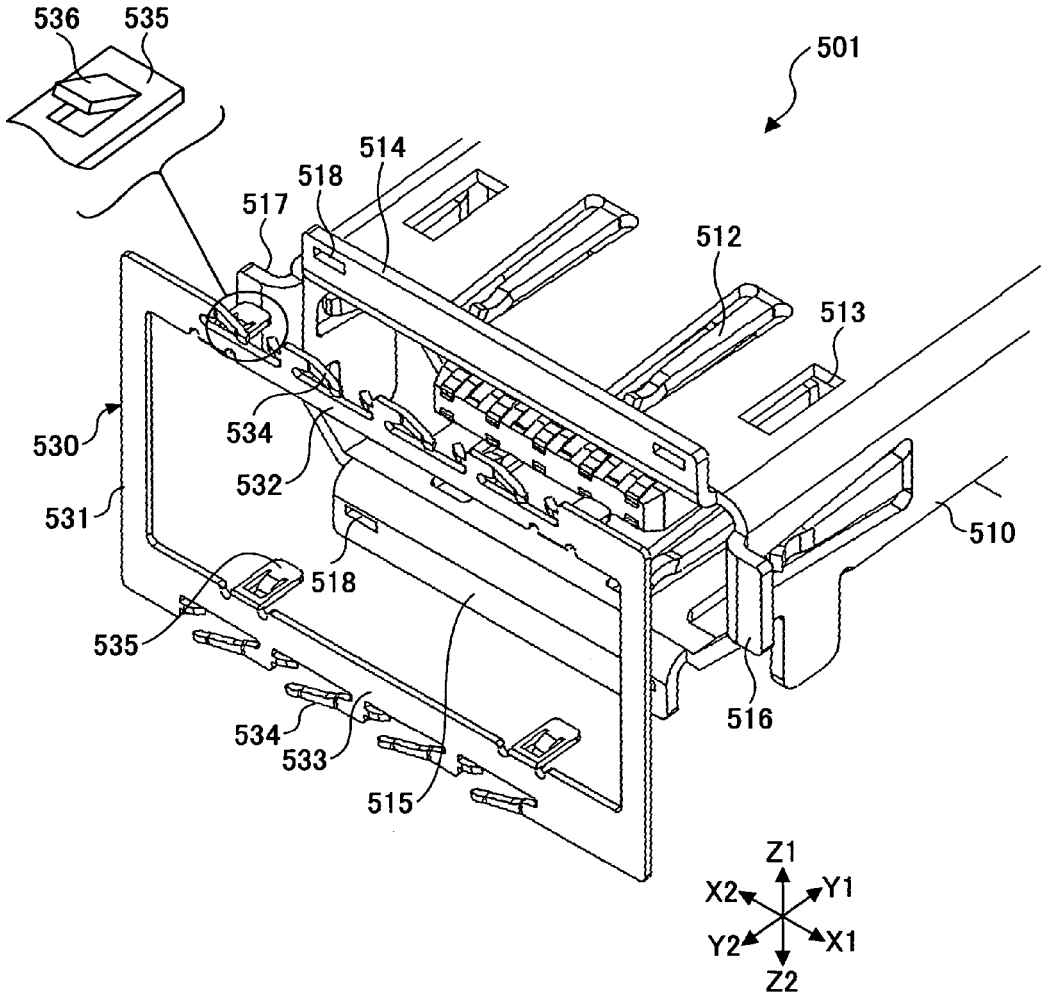
FIG. 32 is a perspective view of the Y2 side of a connector main body with a metal gasket according to the sixth embodiment of the present invention.
Figure 33:
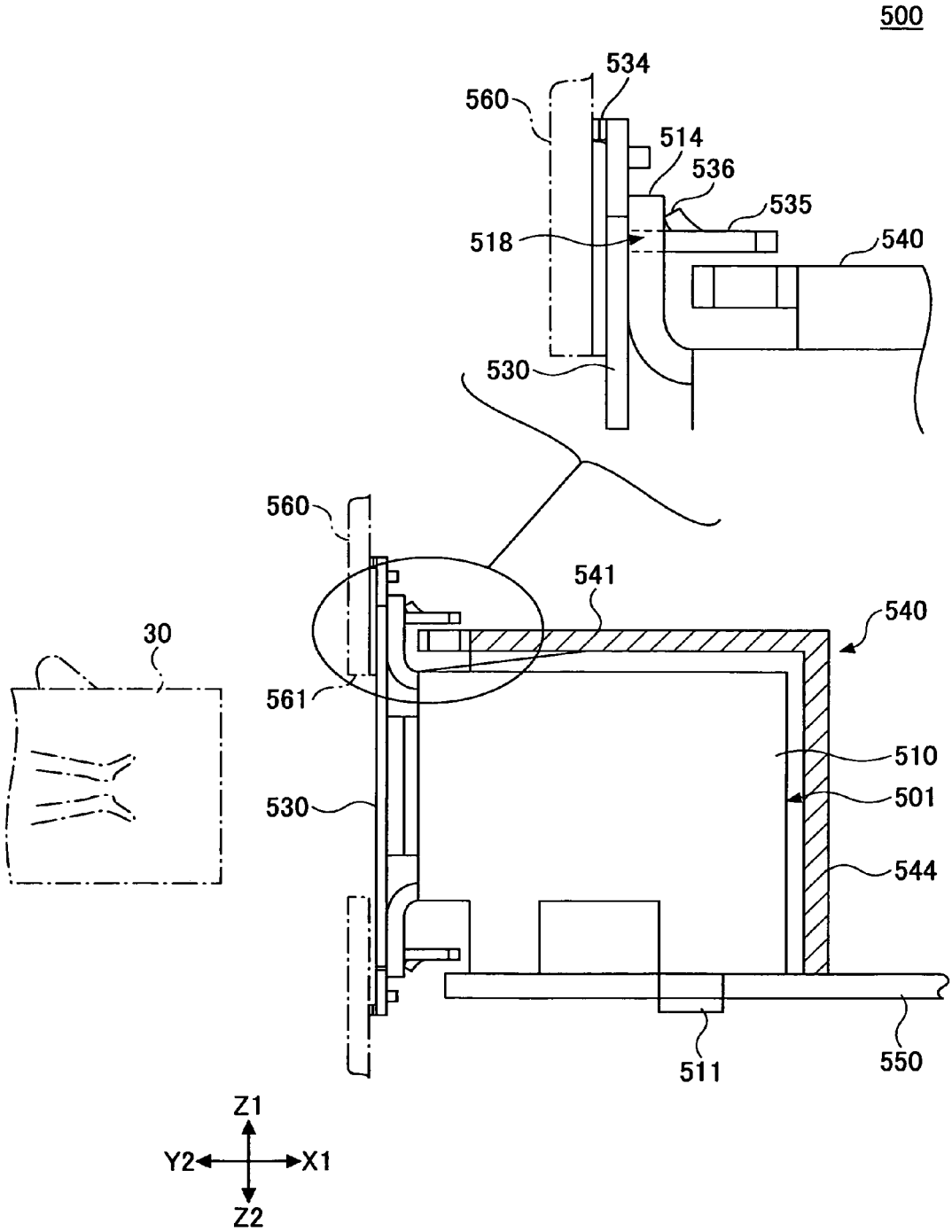
FIG. 33 is a diagram showing the connector for the printed circuit board that is mounted on a printed circuit board according to the sixth embodiment of the present invention.

FIG. 31 is a perspective view of a connector for printed circuit board 500 according to a sixth embodiment of the present invention. In FIG. 31, a connector main body 501, a metal gasket 530, and a shielding member 540 are shown. FIG. 32 is a perspective view of the Y2 side of the connector main body 501 with the metal gasket 530. FIG. 33 is a diagram showing a state in which the connector for printed circuit board 500 is mounted on a printed circuit board 550.

As shown in FIGS. 31 through 33, the connector for printed circuit board 500 has a structure in which the metal gasket 530 and the shielding member 540 are attached to the connector main body 501. The connector for printed circuit board 500 is mounted on an edge part of the printed circuit board 550 of an electronic apparatus (not shown) and is connected to the connector for balanced transmission 50 (50A through 50D).

The connector main body 501 has a structure in which a contact assembly body 502 is assembled in the shielding body 510. The connector main body 501 is a right angle type.

The contact assembly body 502 has a structure in which first and second signal contact members 504 and 505 and grand contact members 506 are arrayed in a block 503 made of an electrically insulating material.

The shielding body 510 is made of a metal plate having a shape surrounding the contact assembly body 502 and has legs inserting to holes of the printed circuit board 550.

The shielding body 510 has plate springs 512 and slits 513 in relation with the cable connector for balanced transmission 50 (50A to 50D). The plate springs 512 contact the shielding cover assembly body 80 (80B) of the cable connector for balanced transmission 50 (50A to 50D) when the cable connector for balanced transmission 50 (50A to 50D) is connected to the connector for printed circuit board 500. Further, when the cable connector for balanced transmission 50 (50A to 50D) is connected to the connector for printed circuit board 500, the hooks 56*c* and 57*c* of the locking arm members 56 and 57 are engaged in the slits 513, then moving of the cable connector for balanced transmission 50 (50A to 50D) is stopped.

The shielding body 510 has flanges 514, 515, 516, and 517 which protrude in the up and down and right and left directions from the ends of the opening of the Y2 side in relation with the metal gasket 530. The flanges 514 and 515 have slits 518 in their right and left sides.

The shielding body 510 has slits 519 in the right and left side plates in relation with the shielding member 540.

The metal gasket 530 is composed of a rectangular frame 531 made of a metal plate. Plural contacting parts 534 being plate springs are formed in an upper side part 532 and a lower side part 533 of the rectangular frame 531. In addition, lugs 535 are formed in the upper side part 532 and the lower side part 533 so that the lugs 535 protrude in the Y1 direction. The lug 535 has a rising part 536.

The lugs 535 of the metal gasket 530 are inserted into the slits 518 of the shielding body 510. As shown in an enlarged part of FIG. 33, the metal gasket 530 is secured to the front of the flanges 514 through 517 so that the rising parts 536 of the lugs 535 passing through the slits 518 stop against the back faces of the flanges 514 and 515.

As shown in FIG. 31, the shielding member 540 is an approximate box-shaped member made of a metal having a size corresponding to the connector main body 501, and has an upper plate part 541, a right side plate part 542, a left side plate part 543, and a back plate part 544 at the Y1 side. A protrusion 545 is formed inside the right side plate part 542 and the left side plate part 543. The shielding member 540 is attached to the connector main body 501 mounted on the printed circuit board 550, and covers the upper side, the right and left sides, and the back side of the connector main body 501.

The connector main body 501 having the metal gasket 530 is mounted on the printed circuit board 550 and the shielding member 540 is attached to the connector main body 501. Further, the printed circuit board 550 is attached inside an electronic apparatus, as shown in FIG. 33. The connector for printed circuit board 500 is disposed at an opening 561 of a panel of the electronic apparatus. The contacting parts 534 contact the back face of the panel 560 by being pressed.

When the connector for printed circuit board 500 is in use, since the shielding member 540 is electrically connected to the panel 560 of the electronic apparatus via the shielding body 510 and the metal gasket 530, the electric potential of the shielding member 540 is ground electric potential. The shielding member 540 covers the upper side, the right and left sides, and the back side of the connector main body 501; therefore, the contact assembly body 502 is well shielded. Consequently, the connector for printed circuit board 500 has an excellent EMI (electro-magnetic interference) characteristic; therefore, emission of noise is prevented, and may not be influenced by outside noise.

Further, the present invention is not limited to these embodiments, but various variations and modifications may be made without departing from the scope of the present invention.

The present application is based on Japanese Priority Application No. 2005-160285 filed on May 31, 2005, and Japanese Priority Application No. 2005-375813 filed on Dec. 27, 2005, with the Japanese Patent Office, the entire contents of which are hereby incorporated by reference.

What is claimed is:

1. A cable connector for balanced transmission, comprising:

a contact assembly body having a block body made of an electrically insulating material in which a pair including first and second signal contact members and a ground contact member are alternately arrayed; wherein a first signal wire connecting part being a part of the first signal contact member sticks out from the back face of the block body, a second signal wire connecting part being a part of the second signal contact member sticks out from the back face of the block body, and a plate part and a drain wire connecting part at the end of the plate part being parts of the ground contact member stick out from the back face of the block body;

the cable connector for balanced transmission, further including a cable for balanced transmission having plural pairs of wires in which the first and second signal wires and the drain wire are disposed; wherein a tip of the first signal wire is connected to the first signal wire connecting part, a tip of the second signal wire is connected to the second signal wire connecting part, and a tip of the drain wire is connected to the drain wire connecting part;

the cable connector for balanced transmission further including a spacer member being a plate-shaped member made of an electrically insulating material that has first grooves that have a shape corresponding to the first signal wire connecting part, second grooves that have a shape corresponding to the second signal wire connecting part, and slits that have a shape corresponding to the plate part of the ground contact member; wherein the spacer member is attached to the back face of the block body, the first signal wire connecting part is inserted into the first groove, the second signal wire connecting part is inserted into the second groove, and the plate part is inserted into the slit, so that the positions of the first and second signal contact members and the ground contact members in relation with the tips of the cable for balanced transmission are decided.

2. The cable connector for balanced transmission as claimed in claim 1, wherein:

the first signal wire connecting part of the first signal contact member is L-shaped in its cross section composed of a horizontal plate part and a vertical side plate part and protrudes in the horizontal direction for a center part of the first signal contact member by a bent crank part, and the second signal wire connecting part of the second signal contact member is L-shaped in its cross section composed of a horizontal plate part and a vertical side plate part and protrudes in the horizontal direction for a center part of the second signal contact member by a bent crank part, and the positions of the first and second signal wires are uniquely decided by being pushed inside corresponding L-shaped corners, and the first signal wire is arrayed with a contact part of the first signal contact member and the second signal wire is arrayed with a contact part of the second signal contact member on the first and second signal wires being straight lines as viewed from the side of the cable for balanced transmission.

3. The cable connector for balanced transmission as claimed in claim 1, wherein:

the drain wire connecting part of the ground contact member is U-shaped, and the position of the drain wire is uniquely decided by being pushed inside the drain wire connecting part.

4. The cable connector for balanced transmission as claimed in claim 1, wherein:

the block body comprises a pair of arms sticking out from both end sides thereof in the back face direction, and the spacer member is attached to the block body in a manner so that both end sides thereof are supported by the pair of arms.

5. The cable connector for balanced transmission as claimed in claim 1, wherein:

the block body comprises a pair of arms sticking out from both end sides thereof in the back face direction, and the spacer member comprises protrusion arms protruding from both sides thereof, the spacer member is supported by the block body in a manner so that the protrusion arms are inserted into a pair of grooves formed in the pair of arms of the block body, and the lengths of the protrusion arms are different and the lengths of the grooves are different, so that the spacer member is not supported by the block body in a wrong attaching direction.

6. The cable connector for balanced transmission as claimed in claim 1, further comprising:

a shielding cover assembly body that surrounds the block body in which the first and second signal contact members and the ground contact members are assembled and the spacer member;

an outer cover that covers the shielding cover assembly body; and a hood that protects a connecting part of the cable for balanced transmission for connection to the shielding cover assembly body, wherein the outer cover has a approximate box shape whose both ends are opened, and the hood has stretching parts, and the outer cover covers the shielding cover assembly body from the side of the cable for balanced transmission with the hood in a manner so that the stretching parts are positioned inside the outer cover.

7. The cable connector for balanced transmission as claimed in claim 1, further comprising:

a shielding cover assembly body that surrounds the block body in which the first and second signal contact members and the ground contact members are assembled and the spacer member;

an outer cover that covers the shielding cover assembly body; and a hood that protects a connecting part of the cable for balanced transmission for connection to the shielding cover assembly body, wherein the outer cover and the hood are formed by resin potting to cover surfaces of the shielding cover assembly body.

8. The cable connector for balanced transmission as claimed in claim 1, wherein:

the contact assembly body comprises a locking arm member; and the locking arm member comprises a hook at a tip thereof inserting into a slit of a connector for a printed circuit board to which the cable connector for balanced transmission is connected; wherein the hook has a slanting part that slants in the direction of the cable connector for balanced transmission.

9. The cable connector for balanced transmission as claimed in claim 1, wherein:

the contact assembly body comprises a locking arm member; and the locking arm member comprises a hook at a tip thereof inserting into a slit of a connector for a printed circuit board to which the cable connector for balanced transmission is connected and a protrusion in the middle thereof; wherein the cable connector for balanced transmission, further includes a shielding cover assembly body that covers the contact assembly body; and an operating section that pushes down the hook by pushing down the protrusion; wherein the operating section is formed by an operating member that is positioned in the upper face of the shielding cover assembly body, and the operating member is attached to the shielding cover assembly body by a part of the outer cover formed by potting or outsert molding in a manner so that the outer cover covers the shielding cover assembly body.

10. The cable connector for balanced transmission as claimed in claim 1, further comprising:

a shielding cover assembly body that covers the contact assembly body;

an outer cover formed by outsert molding to cover the shielding cover assembly body; and an inner cap for preventing a resin from flowing into the shielding cover assembly body at the inserting side of the cable for balanced transmission in the shielding cover assembly body.

11. The cable connector for balanced transmission as claimed in claim 1, wherein:

the first signal contact member and the second signal contact member are vertically positioned on a straight line, and the ground contact members are positioned to sandwich the first signal contact member and the second signal contact member, and the drain wire connecting part of the ground contact member is alternately arrayed up and down.

12. A connector for a printed circuit board, which connector is mounted on the printed circuit board and is connected to the cable connector for balanced transmission as claimed in claim 1, comprising:

a connector main body;

a metal gasket; and a shielding member; wherein the connector main body includes, a contact assembly body in which first and second signal contact members and ground contact members are assembled in an arraying manner in a block made of an electrically insulating material, and a shielding member, the metal gasket includes plural contacting parts that are plate springs, and is attached to the front side of the shielding member, and the shielding member is an approximate box-shaped member having an upper plate part, right and left side plate parts, and a back plate part, and is attached to cover the connector main body.

* * * * *